US009074589B2

(12) United States Patent
Leu et al.

(10) Patent No.: US 9,074,589 B2
(45) Date of Patent: Jul. 7, 2015

(54) PUMP

(75) Inventors: Shawn A. Leu, Newton, WI (US); Stephen M. Moretti, Manitowoc, WI (US)

(73) Assignee: THOMAS INDUSTRIES, INC., Sheboygan, WI (US)

( * ) Notice: Subject to any disclaimer, the term of this patent is extended or adjusted under 35 U.S.C. 154(b) by 561 days.

(21) Appl. No.: 12/345,065

(22) Filed: Dec. 29, 2008

(65) Prior Publication Data

US 2009/0104052 A1 Apr. 23, 2009

Related U.S. Application Data

(62) Division of application No. 11/383,315, filed on May 15, 2006, now abandoned.

(60) Provisional application No. 60/681,814, filed on May 17, 2005.

(51) Int. Cl.
*F04B 35/04* (2006.01)
*F04B 39/12* (2006.01)

(52) U.S. Cl.
CPC ..... *F04B 35/04* (2013.01); *F04B 39/12* (2013.01); *F04B 39/125* (2013.01)

(58) Field of Classification Search
CPC ..... F04B 35/04; F04B 39/12; F04B 39/125
USPC ..... 417/338, 339, 521, 539, 415, 533, 419, 417/363; 92/51, 129, 68, 72–73, 74
See application file for complete search history.

(56) References Cited

U.S. PATENT DOCUMENTS 1,646,754 A * 10/1927 Leahy ..... 417/491
2,134,077 A * 10/1938 Ehret ..... 417/539

(Continued)

FOREIGN PATENT DOCUMENTS

CA 2151173 6/1995
CN 2073524 3/1991

(Continued)

OTHER PUBLICATIONS

Examination Report for companion UK Application No. GB0609668.9 dated Jan. 26, 2010 (2 pages).

(Continued)

*Primary Examiner* — Charles Freay
*Assistant Examiner* — Christopher Bobish
(74) *Attorney, Agent, or Firm* — Michael Best & Friedrich LLP

(57) ABSTRACT

A pump that has a flangeless valve plate, meaning that the valve plate has no flange through which bolts that secure the head to the pump extend. The pump has eccentrics and pistons that all have holes in them so that the pistons at opposite ends of the pump can be assembled to the shaft of the motor 180° out of phase. The pump further has a monolithic head that includes the two head members of the pump and the tube that connects them also has an integrally formed port. The pump is supported by elastomeric tubular members from its ports. The pump has a push-in fitting that can be pushed into a hole in a member such as the head, the housing or the base so that once pushed in, a ring around the fitting expands outwardly behind an edge of the body to trap the fitting in the opening.

17 Claims, 19 Drawing Sheets

(56) References Cited

U.S. PATENT DOCUMENTS

| | | | | | |
|---|---|---|---|---|---|
| 2,605,958 | A | * | 8/1952 | Russell | 92/163 |
| 3,207,083 | A | | 9/1965 | Kermit et al. | |
| 3,273,717 | A | | 9/1966 | Canterbury | 210/167.26 |
| 3,495,540 | A | | 2/1970 | Lowell | |
| 3,635,369 | A | | 1/1972 | Laswell et al. | |
| 4,388,050 | A | | 6/1983 | Schuller | |
| 4,515,540 | A | | 5/1985 | Pillis | |
| 4,560,327 | A | | 12/1985 | Bez et al. | |
| 4,648,815 | A | | 3/1987 | Williams | |
| 4,671,428 | A | | 6/1987 | Spatz | 222/105 |
| 4,764,097 | A | | 8/1988 | Hirahara et al. | |
| 4,824,335 | A | | 4/1989 | Lubitz et al. | |
| 4,889,475 | A | | 12/1989 | Gannaway | |
| 4,936,753 | A | | 6/1990 | Kozumplik et al. | |
| 4,941,899 | A | | 7/1990 | Liu | 73/863.23 |
| 4,990,065 | A | | 2/1991 | Otaki | 417/273 |
| 5,070,767 | A | | 12/1991 | Yuda | |
| 5,290,152 | A | | 3/1994 | Wallace et al. | |
| 5,378,118 | A | * | 1/1995 | Phillips | 417/308 |
| 5,584,675 | A | | 12/1996 | Steurer et al. | |
| 5,630,708 | A | * | 5/1997 | Kushida et al. | 417/273 |
| 5,644,969 | A | * | 7/1997 | Leu et al. | 92/60.5 |
| 5,685,458 | A | | 11/1997 | Durham et al. | |
| 5,755,251 | A | * | 5/1998 | Simonette | 137/115.13 |
| 6,056,521 | A | | 5/2000 | Leu et al. | |
| 6,099,268 | A | | 8/2000 | Pressel | 417/360 |
| 6,126,410 | A | * | 10/2000 | Kung et al. | 417/312 |
| 6,139,280 | A | | 10/2000 | Holt et al. | |
| 6,216,474 | B1 | | 4/2001 | Sishtla | |
| 6,227,821 | B1 | | 5/2001 | Leu et al. | |
| 6,331,101 | B2 | * | 12/2001 | Leu et al. | 417/423.14 |
| 6,412,474 | B1 | | 7/2002 | Guentert et al. | |
| 6,431,845 | B1 | | 8/2002 | Thomas et al. | |
| 6,497,836 | B2 | | 12/2002 | Krause et al. | |
| 6,692,240 | B1 | | 2/2004 | Leonhard et al. | 417/372 |
| 6,767,001 | B2 | | 7/2004 | Anderson | |
| 6,776,589 | B2 | | 8/2004 | Tomell et al. | |
| 6,782,878 | B2 | | 8/2004 | Spix | |
| 7,204,272 | B2 | | 4/2007 | Steinberg | |
| 2001/0009646 | A1 | | 7/2001 | Leu et al. | |
| 2001/0022942 | A1 | * | 9/2001 | Ohashi | 417/464 |
| 2002/0041096 | A1 | | 4/2002 | Krause et al. | |
| 2002/0041098 | A1 | | 4/2002 | Cooper | |
| 2003/0219346 | A1 | * | 11/2003 | Abe et al. | 417/307 |
| 2004/0144373 | A1 | * | 7/2004 | Spix | 123/572 |
| 2004/0187677 | A1 | | 9/2004 | Moradmand et al. | |
| 2004/0244393 | A1 | | 12/2004 | Lucas et al. | |
| 2006/0034708 | A1 | | 2/2006 | Thomas et al. | |

FOREIGN PATENT DOCUMENTS

| | | | |
|---|---|---|---|
| CN | 1120319 | | 9/2003 |
| DE | 31 13 353 | A1 | 3/1982 |
| EP | 0151519 | A1 | 8/1985 |
| EP | 0 764 808 | A1 | 3/1997 |
| EP | 0764808 | A1 | 3/1997 |
| EP | 0 801 228 | A2 | 10/1997 |
| EP | 0 801 228 | A3 | 10/1997 |
| EP | 0801228 | A2 | 10/1997 |
| FR | 2480244 | | 4/1981 |
| GB | 585898 | | 2/1947 |
| GB | 943325 | | 12/1963 |
| GB | 1 415 024 | | 11/1975 |
| GB | 2 132 284 | | 7/1984 |
| GB | 2 132 284 | A | 7/1984 |
| GB | 2132284 | A | 7/1984 |
| JP | 61126395 | | 6/1986 |
| JP | 1-208593 | | 8/1989 |
| JP | 06-257671 | | 9/1994 |
| JP | 09-042454 | | 2/1997 |
| JP | 10-115283 | | 5/1998 |
| JP | 10-252647 | | 9/1998 |
| JP | 11182478 | | 7/1999 |
| JP | 2000257755 | | 9/2000 |
| JP | 2000-320458 | | 11/2000 |
| JP | 2002039069 | | 2/2002 |
| JP | 2003-009459 | | 1/2003 |
| JP | T 2003-515161 | | 4/2003 |
| JP | 2005-054868 | | 3/2005 |
| WO | WO 01/38743 | | 5/2001 |
| WO | WO 2004/101993 | | 11/2004 |

OTHER PUBLICATIONS

Examination Report for companion UK Application No. GB1000154.3 dated Jan. 26, 2010 (3 pages).
Examination Report for companion UK Application No. GB1000155.0 dated Jan. 26, 2010 (3 pages).
Examination Report for companion UK Application No. GB1000153.5 dated Jan. 26, 2010 (2 pages).
Examination Report for companion UK Application No. GB1000152.7 dated Jan. 26, 2010 (2 pages).
Examination Report for companion UK Application No. GB1000151.9 dated Jan. 26, 2010 (2 pages).
Search Report for companion UK Application No. GB0609668.9 dated Dec. 22, 2006 (1 page).
Foreign Search Report issued in sister case GB0609668.9.
GB Patent Office Search Report dated Aug. 25, 2006 for companion GB Application 0609668.9.
Microfilm of Japanese Utility Model Registration Application No. 53-105028 (Japanese Utility Model Laid-Open No. 55-022540).
Japanese Office Action related to companion case 2006-138180.
Office Action from companion DE case 102006023407.3-15 dated Jan. 4, 2008 (advised the elements of what amounts to US claim 21 is unpatentable over 5,070,767).
Second Office Action for CN companion case 200610080563.1 dated Dec. 1, 2010.
Office Action from companion DE case 10 2006 023 407.3-15 (The Examiner is of the opinion that what amounts to claim 21 in US is unpatentable over 3,635,369).
Office Action from companion GB case 1000151.9 dated Jan. 26, 2010.
Claims filed in related U.S. Appl. No. 12/376,908.
Examination Report from companion GB case 0609668.9 dated Sep. 2, 2009.
Search Report from companion GB case 0609668.9 dated Aug. 25, 2006.
Summary of Office Action from companion CN case 200610080563.1 dated Mar. 20, 2009.
Summary of Office Action from companion CN case 201110022408.5 dated Aug. 3, 2011 plus original document.
Summary of Office Action from companion KR case 10-2010-0003760 dated Sep. 12, 2011.
Summary of Office Action from companion KR case 10-2006-0044324 dated Sep. 15, 2009 plus original document.
Office Action, mailed Jul. 28, 2011, regarding U.S. Appl. No. 12/376,908.
A schematic of a cap plug which applicant acknowledges is prior art (2 pages).
Translation of Japanese Office Action: companion case to related U.S. Appl. No. 12/376,908.
Translation of Oct. 2, 2012 Office Action for JP 2009-527530, the companion case of U.S. Appl. No. 12/376,908, filed Feb. 27, 2009 with related matter.
Machine language translation for Mar. 3, 2005 Japanese publication 2005-054868.
Final Rejection of U.S. Appl. No. 12/090,646 dated Jan. 20, 2012.
Summary of French Opinion.
French Search Report for French companion case, application No. 06 04420, filed May 17, 2006.
French Written Opinion for French companion case, application No. 06 04420, filed May 17, 2006.
Corrected Summary of French Opinion.
French Search Report for French companion case, application No. 06 04420, filed May 17, 2006 (previously submitted).
French Written Opinion for French companion case, application No. 06 04420, filed May 17, 2006 (previously submitted).

(56) References Cited

OTHER PUBLICATIONS

Office Action from companion case CA 2,547,070 dated Mar. 14, 2012.
Office Action from companion case DE 10 2006 023 407.3-15 issued in 2011.
Explanation of the Office Action from companion case DE 10 2006 023 407.3-15 issued in 2011.
English translation of Japanese Office Action for companion case, application No. 2011-287534 (3 pages).
JP Abstract of JP 10115283 perviously disclosed as US 6,056,521(2 pages).
Partial English translation of JP 63-112694 (3 pages).
Drawing of Ratchet Pin Used in a Pump, the Construction is Acknowledged Prior Art, in Public Use in the US Prior to May 16, 2004 (1 page).
Drawing of Pressure Relief Valve Used on a Pump, the Construction is Acknowledged Prior Art, in Public Use in the US Prior to May 16, 2004 (1 page).

* cited by examiner

PUMP

CROSS-REFERENCE TO RELATED APPLICATION

This application is a divisional of U.S. application Ser. No. 11/383,315 filed May 15, 2006 now abandoned which claims domestic priority from 60/681,814 filed May 17, 2005.

STATEMENT CONCERNING FEDERALLY SPONSORED RESEARCH OR DEVELOPMENT

Not applicable

FIELD OF THE INVENTION

This invention relates to pumps, both compressors and vacuum pumps, and in particular to improvements to improve the assembly and manufacture of pumps.

BACKGROUND OF THE INVENTION

Pumps of the general type described herein are well known. Such pumps may have one, two, or more pumping chambers and generally have a piston (e.g., a wobble piston, an articulated head piston or a diaphragm piston) reciprocating in the pumping chamber that is driven by a motor. If there are two pumping chambers with parallel axes, the motor is typically between two housings that define the crankcases of the pump and join the motor to the pumping chambers, with the motor shaft axis perpendicular to the pumping chamber axis. In a useful form, a monolithic head spans the two pumping chambers, for example as in U.S. Pat. No. 6,056,521, which is hereby incorporated by reference.

The ends of the housings opposite from the motor have typically been closed off at least partially with a fan guard that lets air through or a cover of some kind that required additional fasteners to hold the cover on. This required additional assembly and additional parts. In addition, the valve plate, which, if separate from the head, is typically provided right below the head, typically had flanges through which the tie rods would extend that hold the head on the housing, with the cylinder and possibly other parts in between. These flanges could create problems in assembly by requiring orientation of the valve plate to register with the bolt holes of the head and also in some cases could result in leakage, for example if the head flange would interfere with the flange of the valve plate. In other structures, the valve plate required separate fasteners apart from the fasteners that held the head on, to hold the valve plate on.

In addition, each piston is assembled to the drive shaft and formerly this was typically done with flats on the motor shaft, the flat on one end being 180° out of phase with the flat on the other end so that the pistons were out of phase also. The set screw against a flat introduces errors in assembly in that they do not necessarily result in the pistons being 180° out of phase. For single-ended pumps, the phase is not an issue, but for double-ended pumps, a reliable method is needed to assure that the pistons are 180° out of phase, while not making assembly difficult.

In addition, these pumps can find many different applications. For that reason, it is useful to have different port arrangements possible for these pump configurations.

Pumps of this type also can be provided with different removable or separate port arrangements. For this purpose, it would be useful to have an easy way to add a port or a plug to the pump.

Also as is well known, pumps of this type can produce significant noise and vibration. Isolation is a major design goal in most applications. A solution is needed in this area as well which results in good performance at low cost and easy assembly.

SUMMARY OF THE INVENTION

In one aspect, the invention provides a pump with a boltless cover that is held on the end of a housing of the pump by only a compressed ring between the cover and the housing. The hole in the housing has a chamfer that compresses the ring when the cover is inserted into the hole and the ring seats against the hole to hold the cover to the housing. The cover has a flange that stops excessive insertion of the cover into the housing. The cover can be provided with a port, and can be subjected to a vacuum force by the crankcase, particularly if intake of the pump is through the crankcase.

In another aspect the pump has a flangeless valve plate, meaning that the valve plate has no flange through which bolts that secure the head to the pump extend. Elimination of the flange helps cure a leak problem between the valve plate and the head that can be caused by the flanges. With the flange gone, other features may be provided on the valve plate and the head so as to angularly orient the valve plate relative to the head. Angular orientation is preferred in some applications to prevent interference with the valve or valves on the valve plate.

In another aspect, the pump has an eccentric and pistons that all have holes in them so that the pistons at opposite ends of the pump can be assembled to the shaft of the motor 180° out of phase. Two holes 180° spaced apart are provided in one of the piston and the eccentric and one hole alignable with either of the two holes is provided in the other of the piston and the eccentric. At one end of the pump, the one hole and one of the other two holes are aligned with each other and at the other end of the pump the one hole and the other of the other two holes are aligned with each other, which results in the required 180° out of phase relative positions between the two pistons. In this aspect, a magnetic fixture can be provided with two pins to help align the three holes.

In another aspect, a monolithic head that includes the two head members of the pump and the tube that connects them also has an integrally formed port that provides a passageway into the tube, between the two head members. In the preferred form, the port is halfway between the two head members.

In another aspect, the pump is supported by elastomeric tubular members from its ports. Elastomeric tubular members may extend between a base and the ports of the pump, and the ports may be the inlet ports, the outlet ports, or both. In this aspect, the elastomeric mounting could be such that it is stiffer when the pump is operating so that when the pump is not operating the pump is rested on a hard mount, as may be useful during shipping.

In another aspect, the pump has a push-in fitting that can be pushed into a hole in a member such as the head, the housing or the base so that once pushed in, a ring around the fitting expands outwardly behind an edge of the body to trap the fitting in the opening. A sealing ring can also be provided around the fitting that seals between the fitting and the body.

These and other objects and advantages of the invention will be apparent from the detailed description and drawings.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENT

Figure 1:
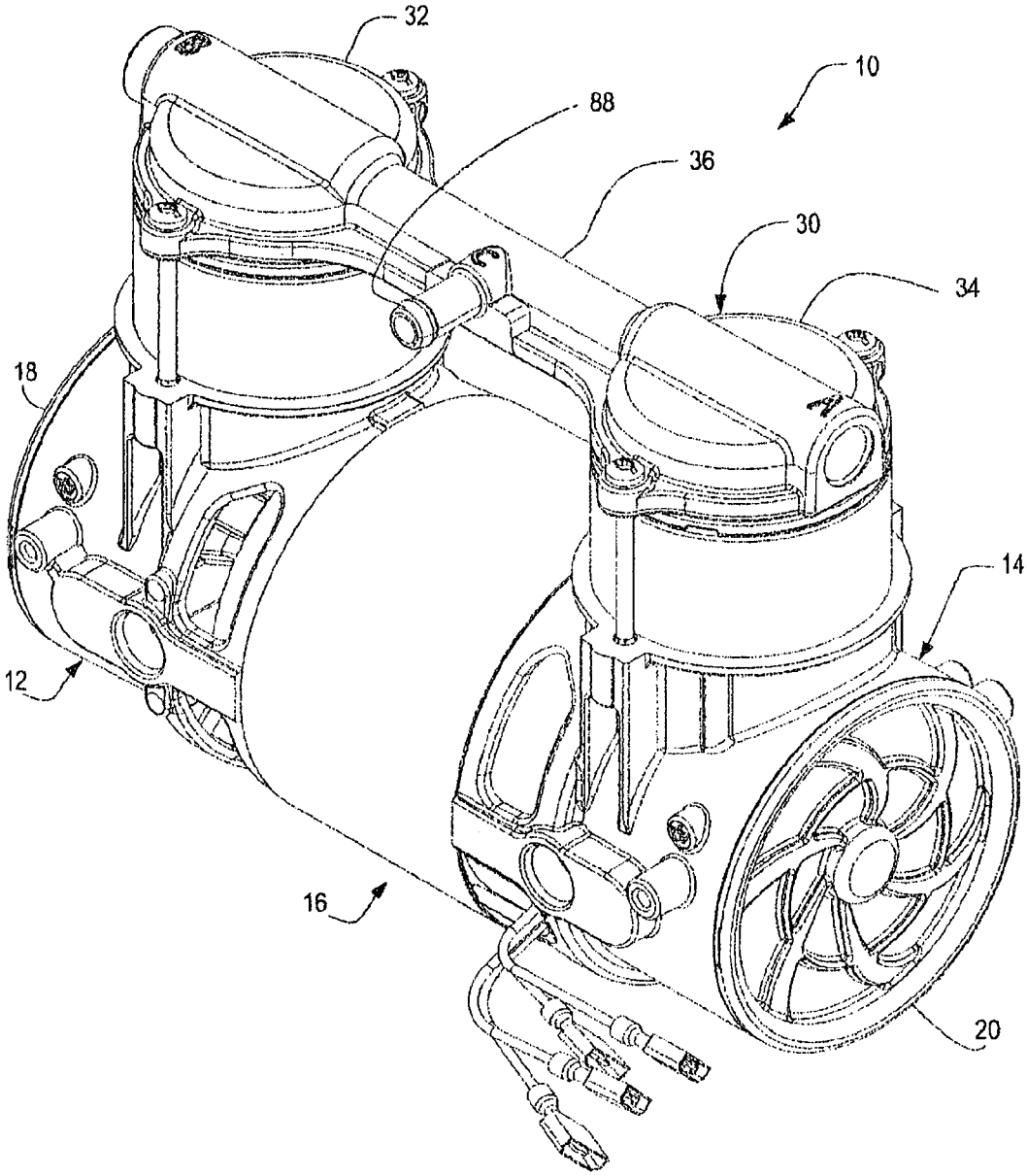
FIG. 1 is a perspective view of a pump incorporating the invention.

Referring to FIGS. 1-4, a pump 10 of the invention includes two housings 12 and 14 which are identical to one another, a motor 16 between the housings, covers 18 and 20 on the ends of the housings opposite from the motor 16, which are also identical to one another, identical cylinders 22 and 24, identical valve plates 26 and 28, and a monolithic head 30 including two head members 32 and 34 joined integrally by a tube 36, and fasteners and seals that hold and seal all the parts together. The head 30 is bolted by bolts 40 at each end to the respective housings 12 and 14, which clamps the valve plates 26 and 28 and the cylinders 22 and 24 to the housings 12 and 14, respectively.

Referring particularly to FIGS. 4-7, the pump 10 draws its intake air through ports 42 and 44 in the bottom of the respective housings 12 and 14. The intake flapper valves 46*a*, 48*a* to the pumping chamber are provided in the piston head 46 or 48 (FIG. 2) and through these flapper valves the air enters the respective pumping chamber 200, 201 defined by the respective cylinder 22, 24, piston 25, 27, and valve plate 26 or 28. The air can be exhausted through valves 28*a*, 26*a*, through tube 36 and out port 88. The head 30 could of course be made to include integrally the valve plates 26 and 28, in which case the covers of the head could be formed as separate pieces, the covers being formed integrally in the head 30 as illustrated.

The covers 18 and 20 are plastic molded components, and do not have any openings through them, although they could have an opening through them, for example, a port, and a filter such as a HEPA filter or a felt filter could be provided on the inside of the cover to filter the incoming or exiting air. As illustrated, the covers need not have any holes through them, since the intake is through the bottoms of the housings. The covers could also be fan guards that would let air through them, if a fan blade was provided on the motor shaft.

Figure 7:
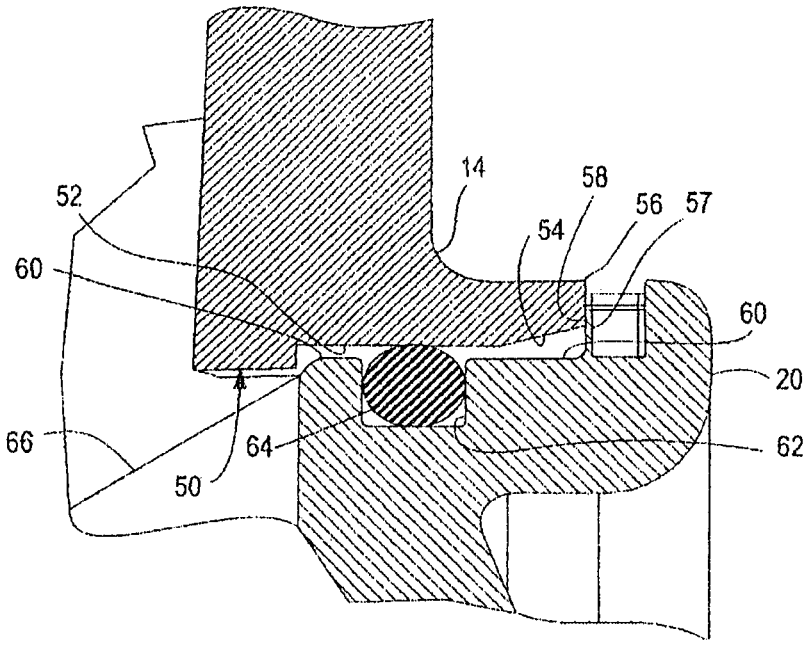
FIG. 7 is an enlarged portion of FIG. 6B.

Only cover 20 is described in detail, since cover 18 is identical. The cover 20 is held onto the housing 14 by being of a circular shape and fitting into a circular hole 50 that is machined in the end of the housing 14, which may be a cast aluminum alloy material or another hard, strong material. Referring to FIG. 7, the circular hole 50 has a cylindrical portion 52 and a frusto-conical portion 54 that opens to the outside and tapers in the inward direction. The housing 14 has end face 56 that abuts flange 58 of cover 20 to stop further insertion of the cover 20 into the hole 50. The hole 50 may also have a shoulder 66 at its inner end which serves to stop insertion of the cover 20. Chamfer 54 guides the cover 20 into the cylindrical portion 52 as the extending portion 60 of the cover 20 is of generally the same diameter as the portion 52, although slightly smaller. Extending portion 60 also includes an o-ring groove 62 in which sealing ring 64 resides which is a compressible elastomeric o-ring. A standard o-ring fit between the cover 20 and the housing 14 is acceptable. The ring 64 is compressed between the cover 20 and the housing 14 and serves to provide the only force to hold the cover 20 and fix the cover 20 to the housing 14 both when the pump is operating and when it is not operating.

When operating, the cover 20 is subjected to a cyclic vacuum force from the reciprocation of the piston in the cylinder, when the piston is drawing air into the pumping chamber through the bottom of the housing 14. This vacuum also helps hold the cover 20 in the hole 50. The ring 64 provides the only constant force that holds cover 20 in the hole 60 secured to the housing 14 and therefore the cover may be referred to as "fastenerless", which enables easy push-in assembly of the cover 20 to the housing 14. A screwdriver slot or recess 57 may be provided in the edge of the flange 58 to create a space to allow prying the cover 20 out of the hole 50 for disassembly.

The o-ring 64 also provides a seal to keep air, dirt, liquids, and other debris from entering the housing 14 through the interface between the cover 20 and the housing 14. The sealing ring 64 could be an elastomeric o-ring, as illustrated, or could be any of a number of other types of sealing rings, such as a quad ring, a square cross-section or other shaped cross-section of an o-ring, or a standard o-ring. The material of the o-ring may, for example, be silicone, which is a standard material for an o-ring. If the interface between the cover 20 and the housing 14 did not need to be sealed, for example if the cover 20 was a fan guard, the ring 64 could be a split ring, for example of plastic or metal, which is capable of creating a friction force against the hole 50 to retain the cover 20. In addition, a groove or shoulder could be formed in the hole 50 for the ring 64 to seat in, so as to provide a form fit as well as a friction fit, to increase the holding force.

It is also noted that subjecting the cover to a vacuum, which a ring 64 that seals facilitates, stresses the cover which tends to stiffen it and reduce noise that may otherwise emanate from the cover.

Figure 8A:
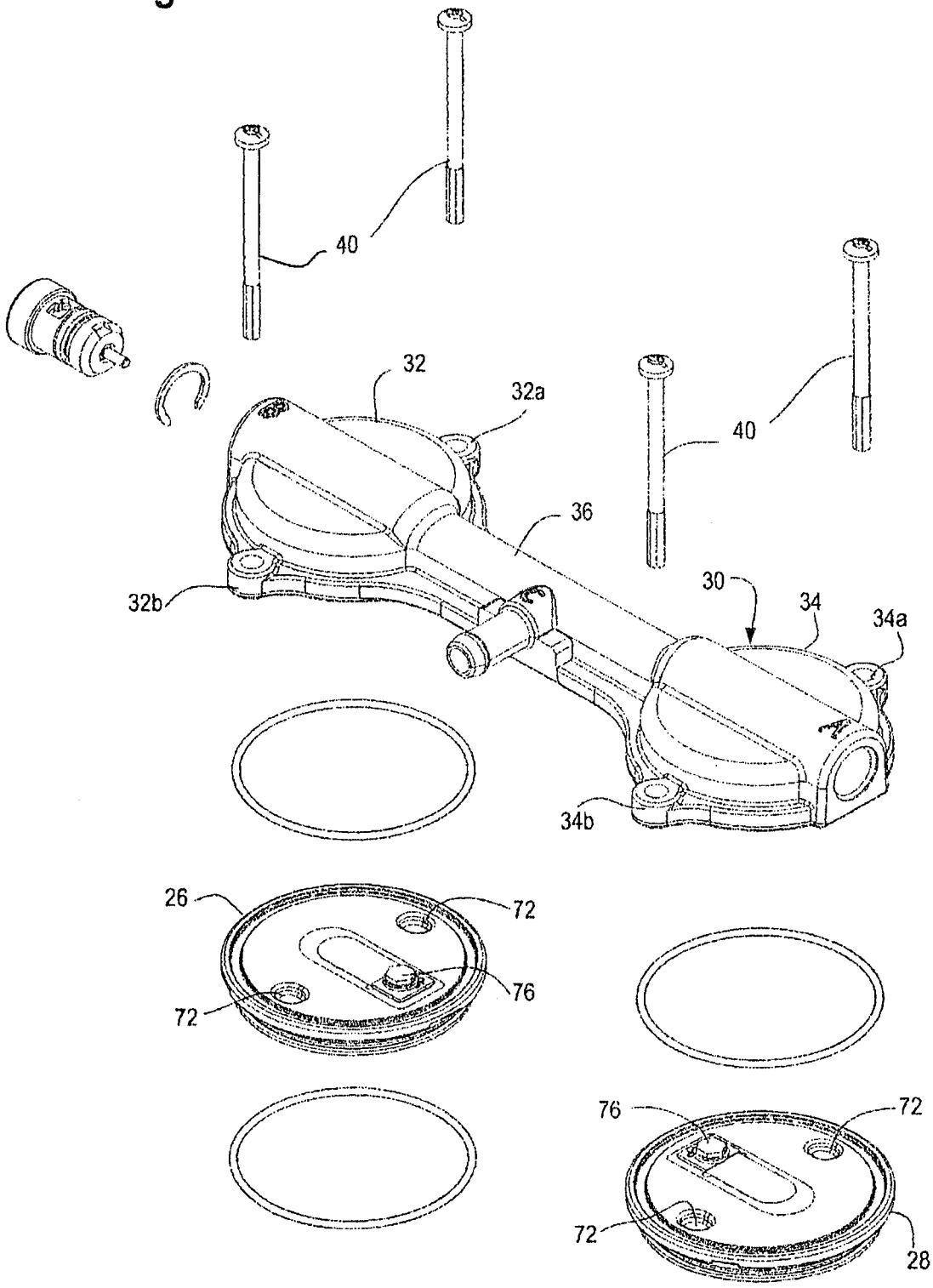
FIG. 8A is an enlarged perspective view of the top portion of the pump, as viewed from the top.
Figure 8B:
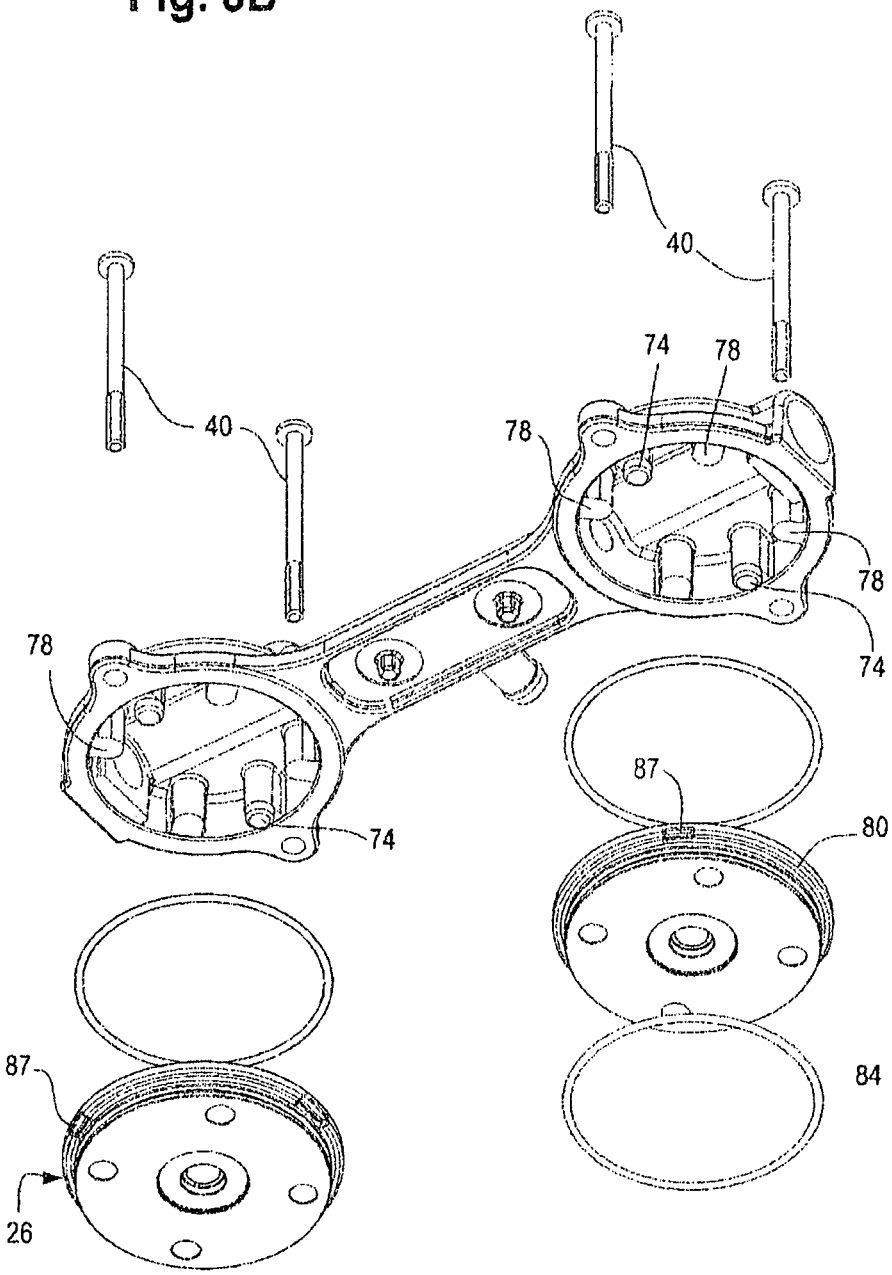
FIG. 8B is an enlarged perspective view of the top portion of the pump, as viewed from the bottom.
Figure 8C:
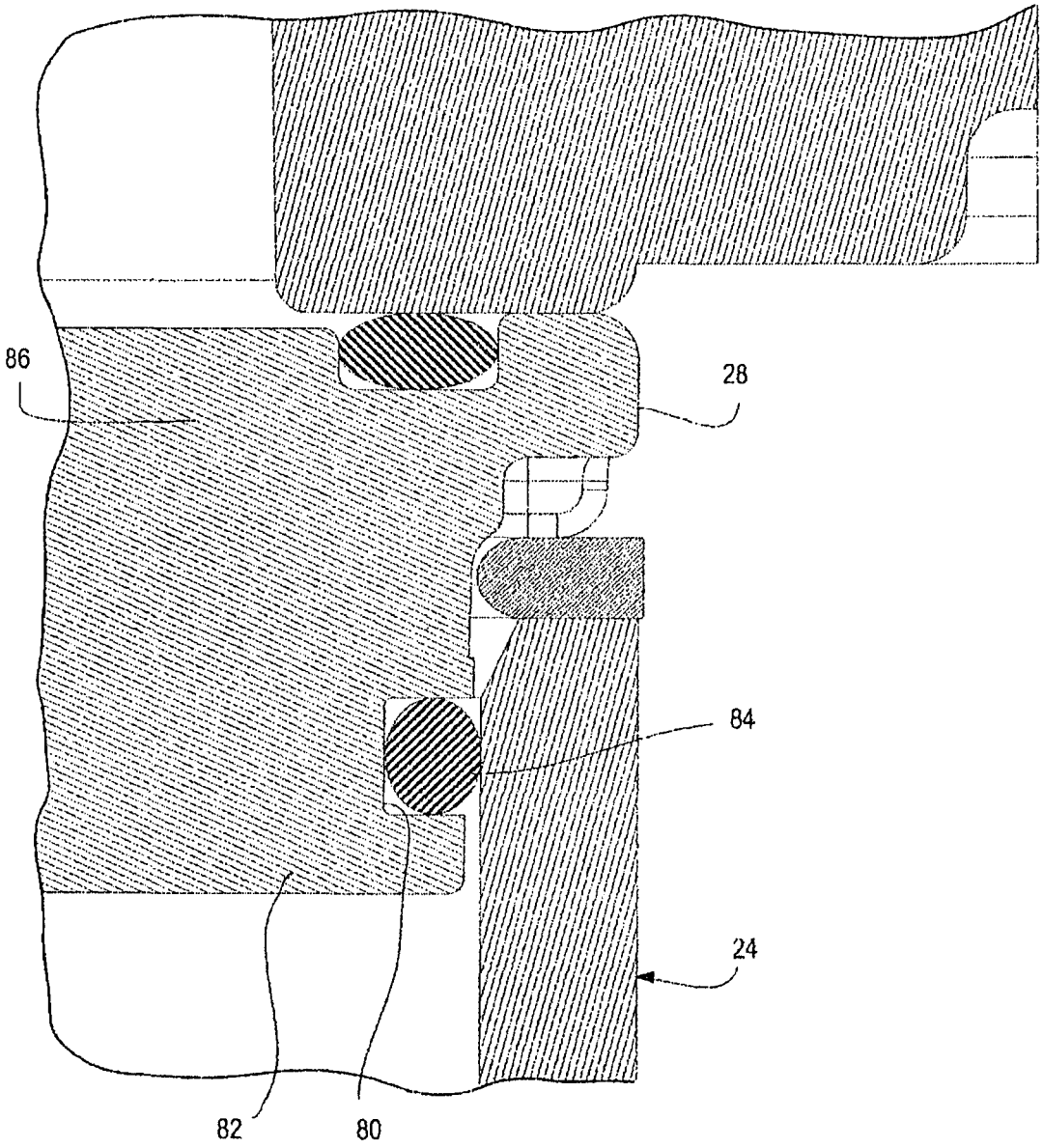
FIG. 8C is an enlarged portion of FIG. 6B.

Referring to FIGS. 8A-C, the valve plates 26 and 28 are fastened in the assembly of the pump by only the clamping force provided by the bolts 40 which pass through apertures (34*a*, 34*b*, 32*a*, 32*b*) and along side valve plates 28, 26. No fasteners extend through the valve plates 26 and 28, as is apparent in the drawings. Formerly, in prior art typical for this type of pump, the valve plates 26 and 28 had separate fasteners holding them in the assembly or had a flange, similar to the bolt flange of the head 30, through which the bolts 40 would extend. It has been found that the elimination of this flange reduces leaking problems that can occur between the valve plate and the head 30. Elimination of separate fasteners also facilitates assembly.

Using flanges or separate fasteners in prior art valves had the effect of providing an orientation of the valve plate, which is desirable so that the fastener that holds the flapper on the valve plate does not interfere with formations on the underside of the head, such as the ejector pin lands. When the flange and separate fasteners of the valve plates are eliminated, the valve plates can be assembled in any orientation unless some other means is provided to limit the orientation. For this purpose, the upperside of each valve plate 26, 28 is provided with a kidney shaped recess 72 (FIG. 8A). In addition, the underside of the head 36 is provided with two pins 74 (FIG. 8B) at each end that fit into the recesses 72 so as to position the fastener 76 of the flapper valve in the valve plate 26, 28 away from the ejector pin lands 78.

The valve plates 26 and 28 are shaped so as to have an extending portion 82 that extends down into the top of the respective cylinder 22 or 24. The extending portion 82 has a sealing ring groove 80 in which a sealing ring 84 is positioned to seal against the inside surface of the respective cylinder 22 or 24. The sealing ring may be a standard o-ring, a square cross-section o-ring, a quad ring, or any other kind of sealing ring. The inside of the respective cylinder 22 or 24 provides an especially preferred surface for sealing against, as its roundness is superior to that of the exterior surface of the cylinder, and it is anodized for a good smooth surface to seal against. Also, the sealing ring slides into the cylinder better than it slides on the outside surface of the cylinder.

The part of the valve plate 28 that is near the top of the valve plate and extends above the extending portion 82 is referred to herein as portion 86. The portion 86 may be formed with one or more recesses 87 to allow prying the valve plate out of the cylinder with a flat blade screw driver.

Figure 2:
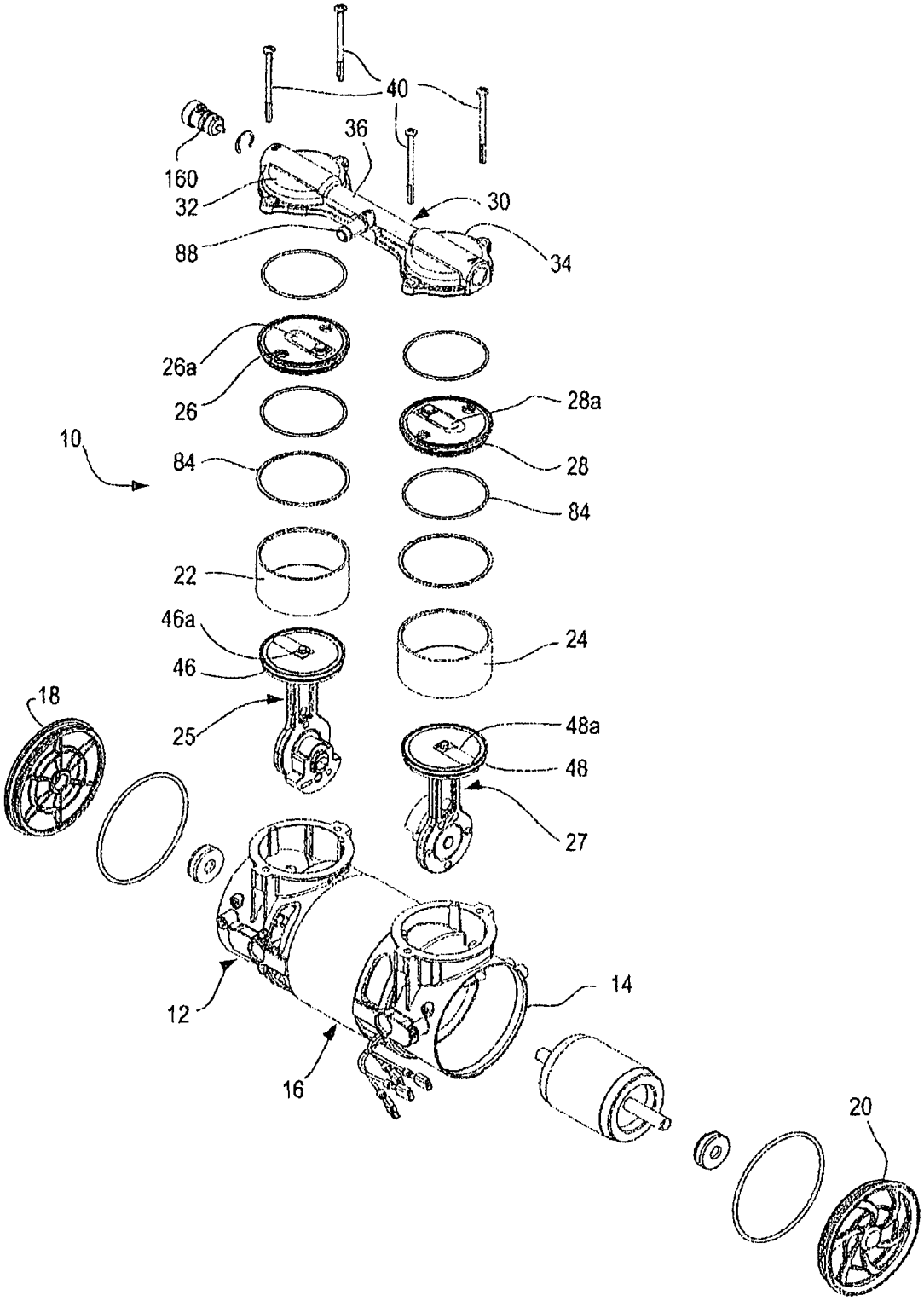
FIG. 2 is a top exploded perspective view of the pump of FIG. 1.
Figure 3:
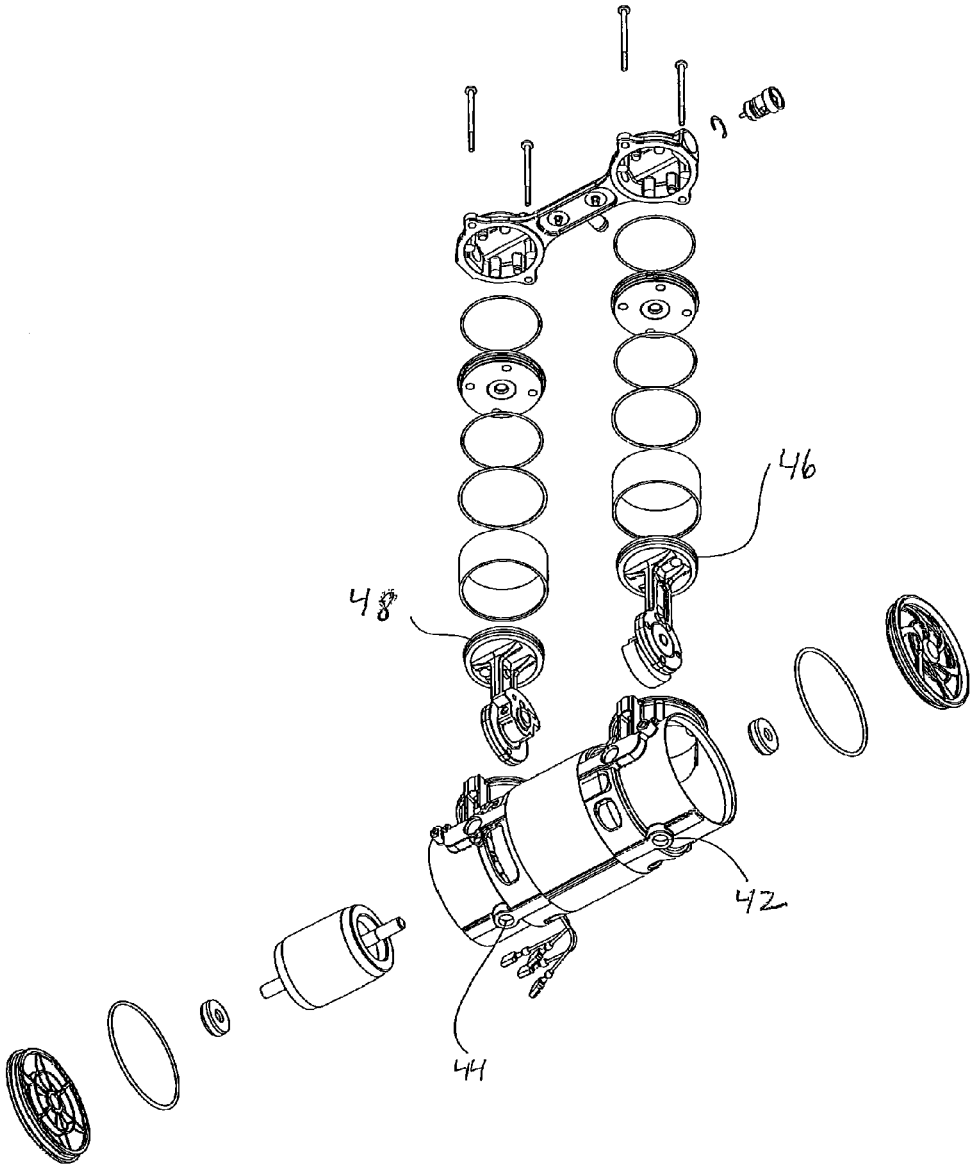
FIG. 3 is a bottom exploded perspective view of the pump of FIG. 1.
Figure 4:
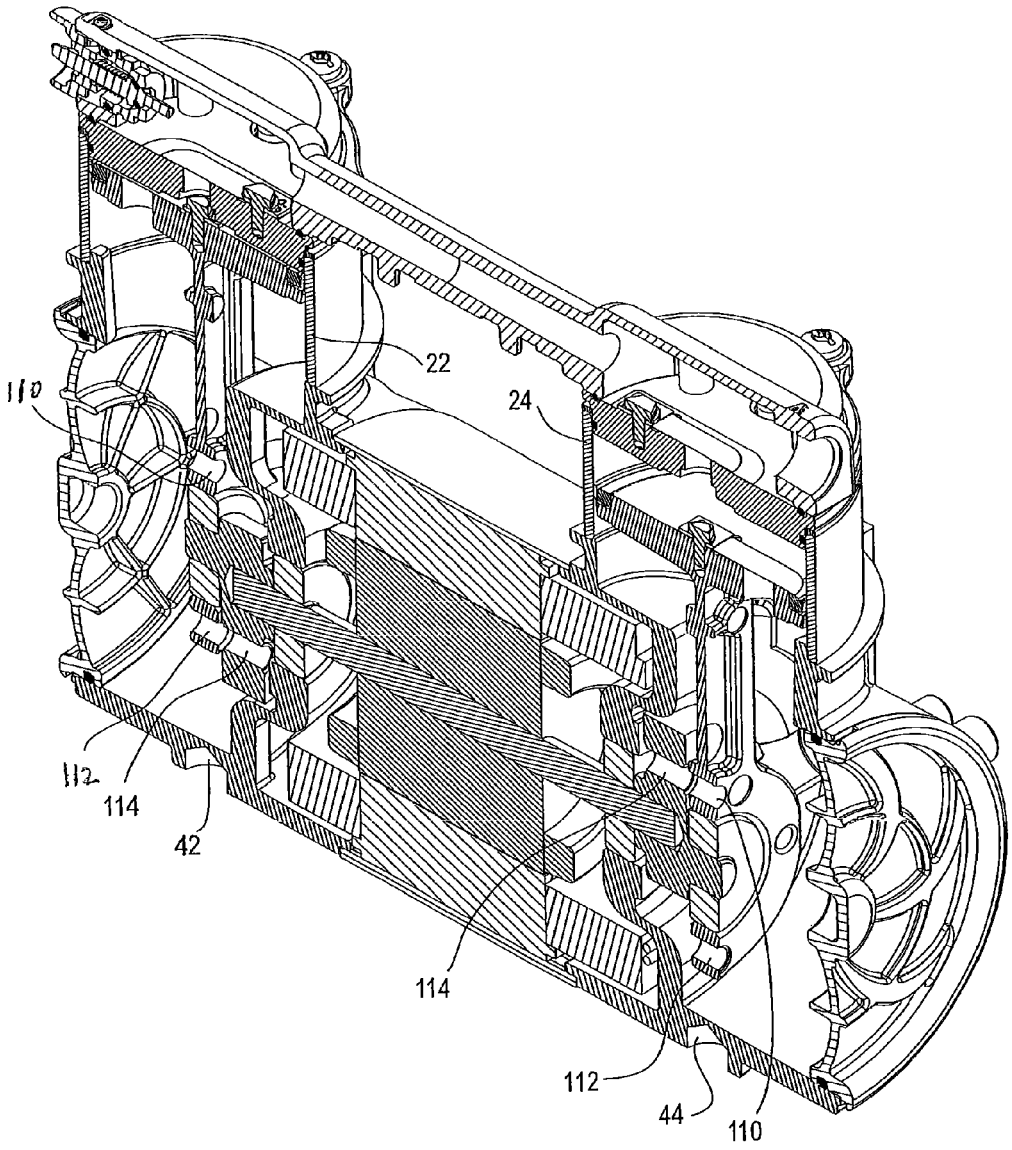
FIG. 4 is a cross-sectional perspective view of the pump of FIG. 1.
Figure 5:
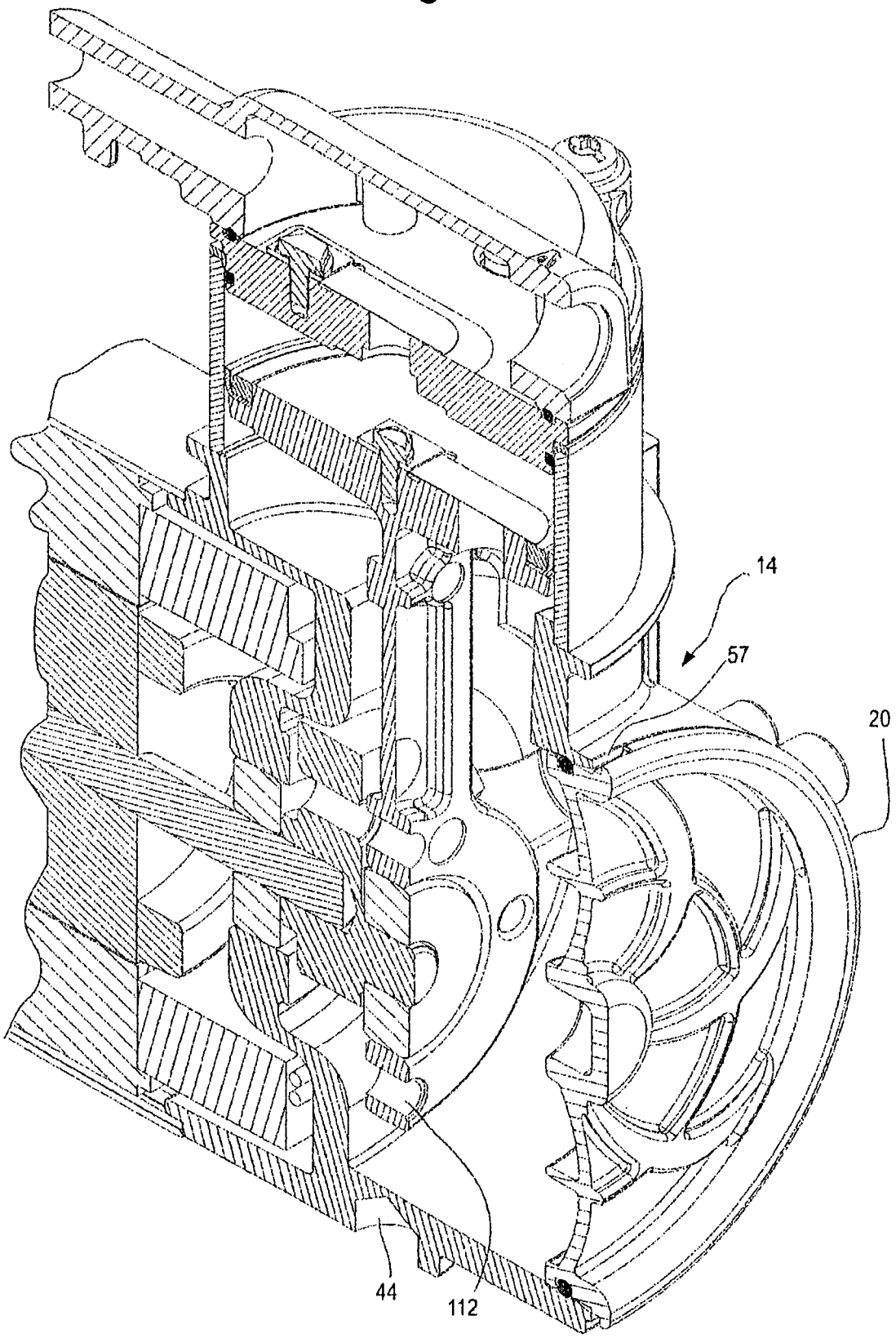
FIG. 5 is an enlarged portion of FIG. 4.

Referring to FIGS. 1-3, the tube 36 of the head 30 has a port 88 that is formed integral with the tube 36 and the inside of the port 88 communicates directly with the inside of the tube 36, which, of course, provides communication to the interior of both of the head members 32 and 34. Providing a port formed integrally with the tube 36 between the head members 32 and 34 provides for connection applications that are broader in scope than merely providing ports in the head members 32 and 34. Also, providing a port at this location permits providing for a three-point mounting as described below with reference to FIG. 14. Also, casting all of the parts of the head 30 in one piece, i.e. both head members 32 and 34, the tube 36, and the port 88 in one piece, provides for excellent structural rigidity of the head 30 so that the head 30 can be used as a handle, and it can also be used to support the weight, or at least part of the weight of the pump, as in the side mounting application of FIG. 14.

Figure 9:
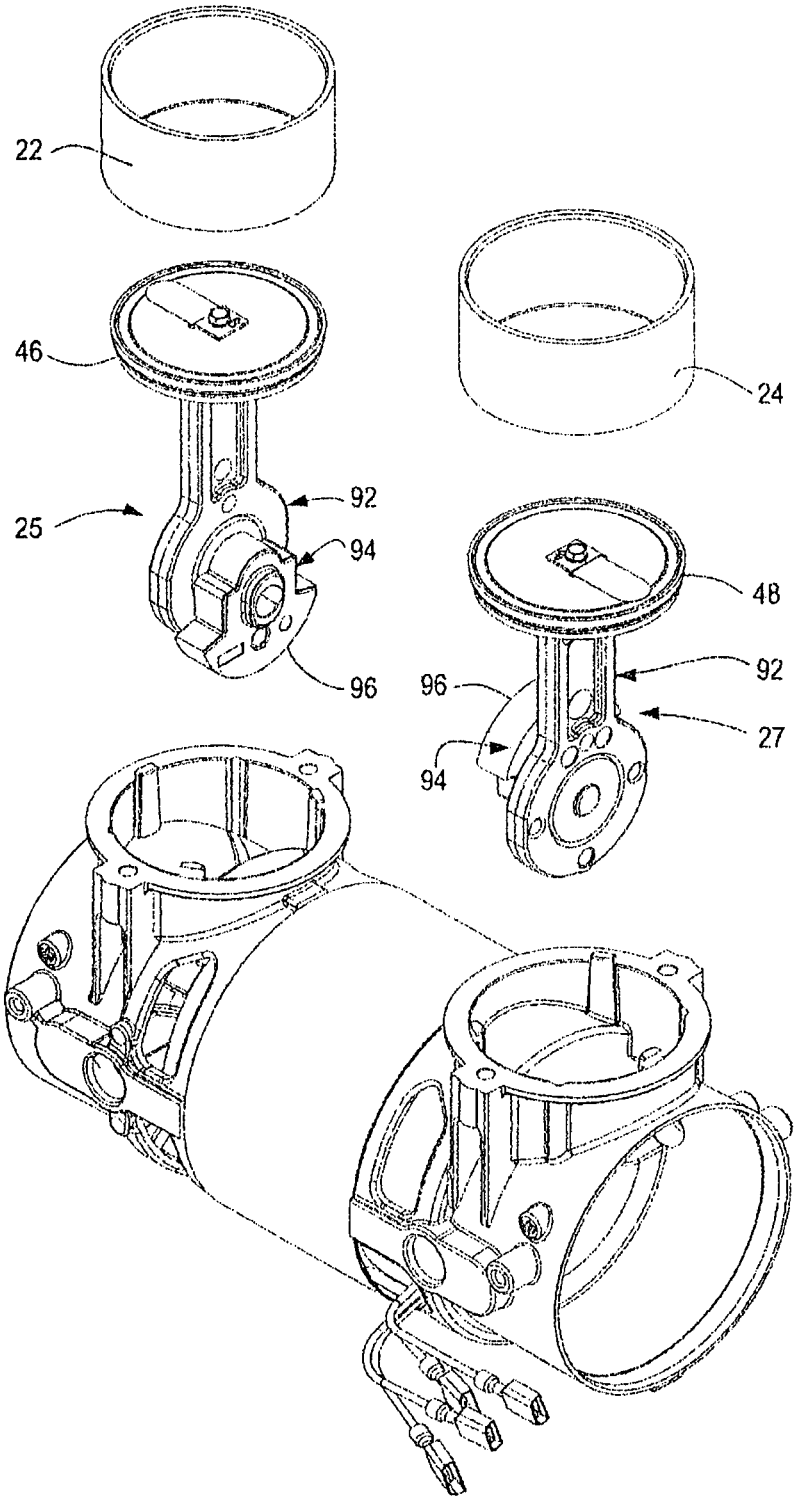
FIG. 9 is an enlarged exploded perspective view of the pistons, eccentrics and associated parts of the pump.

Referring particularly to FIG. 9, each piston assembly 25 and 27 includes a piston 92 that has the piston head 46, 48 formed integrally with the connecting rod, as the pump 10 is a wobble piston-type pump. Other types of pistons include diaphragm pistons or articulated head pistons. The term "piston" as used herein is intended to include types of pistons. As is well known, the piston heads of the pistons 92 have a retainer that holds on a cup seal that forms a sliding seal with the respective cylinders 22 and 24.

Figure 6A:
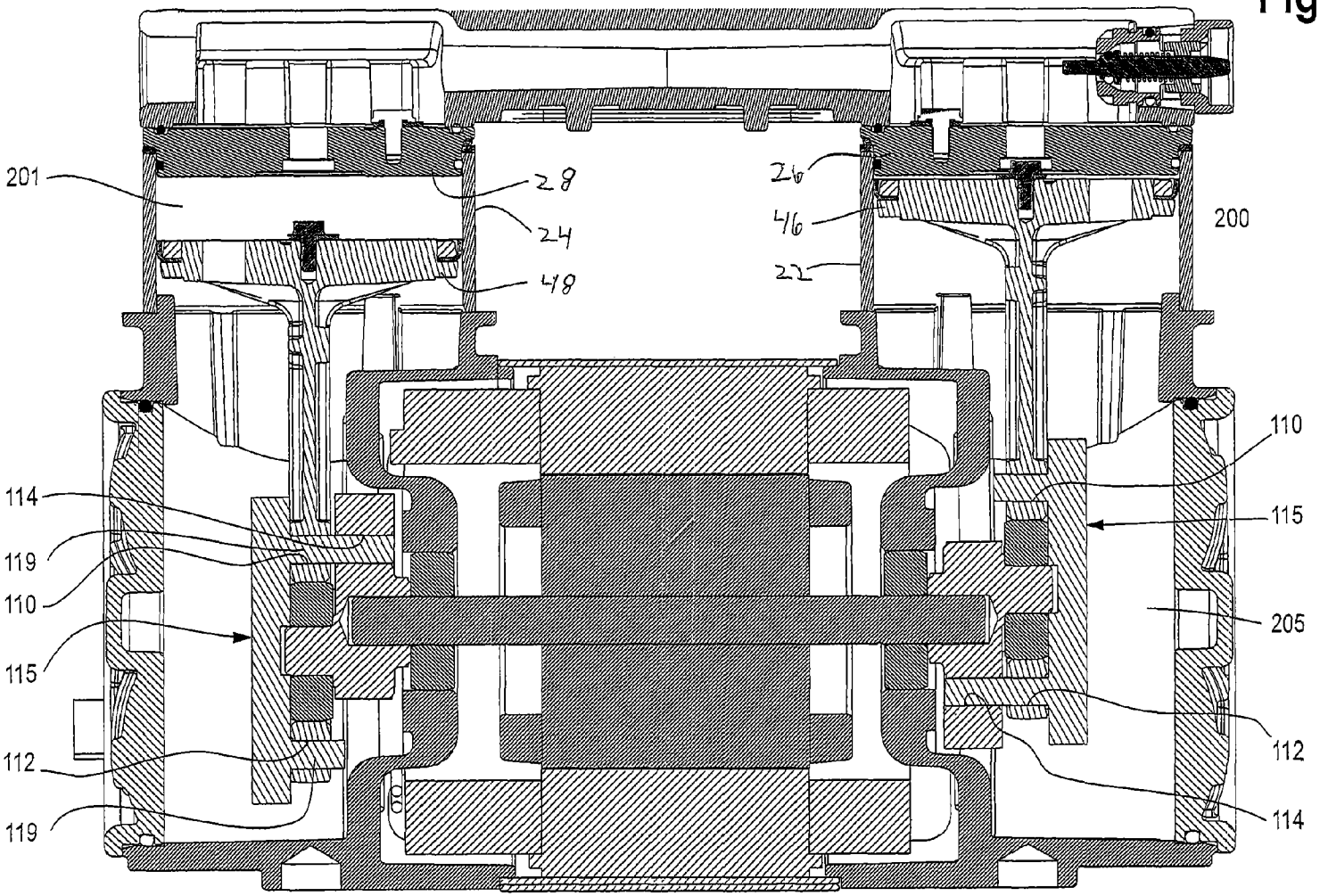
FIG. 6A is a cross-sectional plan view taken along the longitudinal axis of the pump.
Figure 6B:
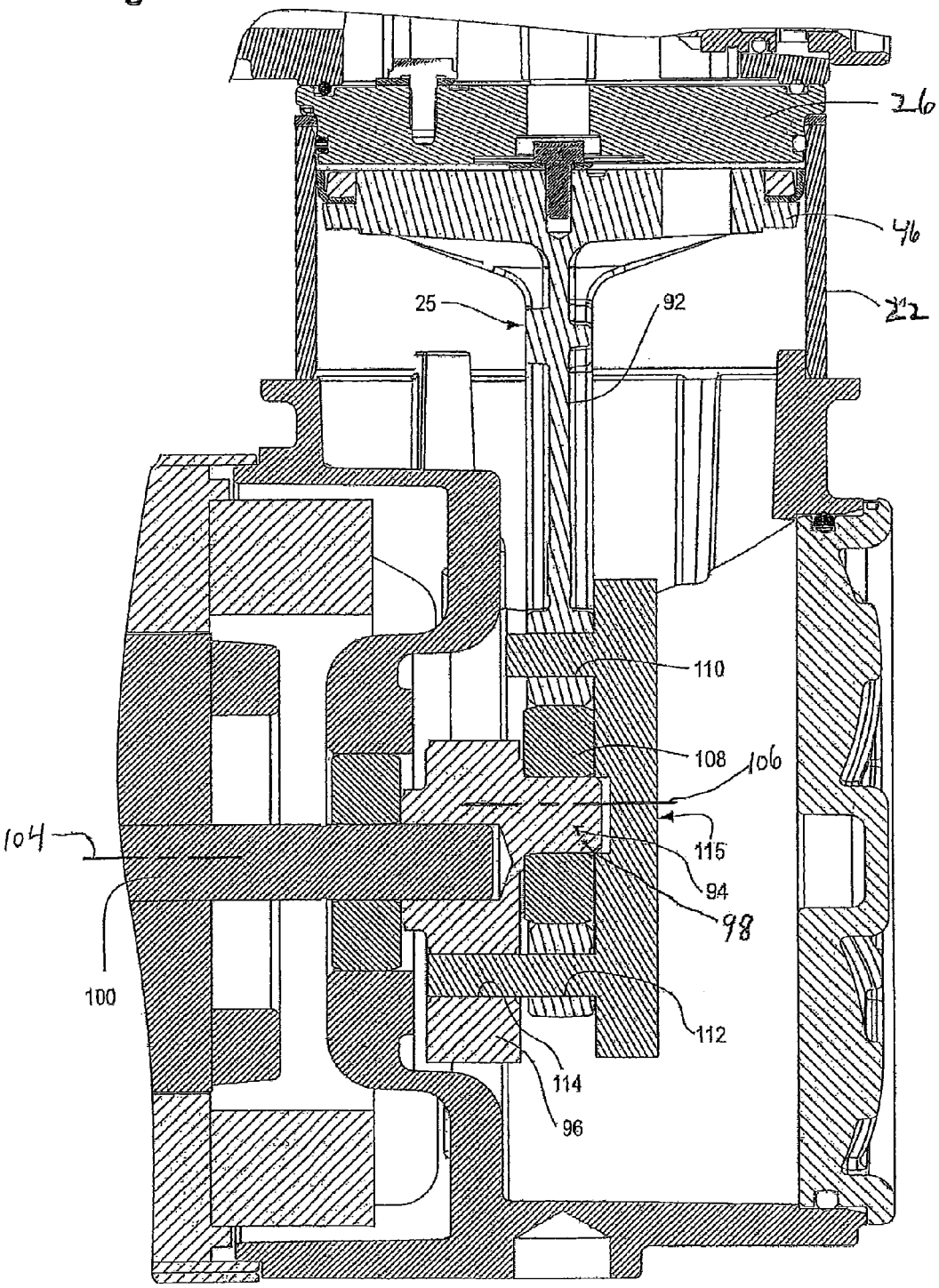
FIG. 6B is an enlarged portion of FIG. 6A.

Referring to FIG. 9, each piston assembly 25, 27 also includes an eccentric 94, for example, made of steel, that has a counterweight portion 96 and a stub portion 98 (FIG. 6B). The piston assemblies 25, 27 are secured to opposite ends of motor shaft 100 via their respective eccentrics 94. For that purpose, each eccentric 94 has a hole sized to receive the end of the shaft 100 and a threaded fastener not shown, e.g. a set screw that can be tightened against the shaft to secure the eccentric and the piston assembly on the shaft. The shaft axis 104 is spaced apart from and is parallel to the stub axis 106 such that when the shaft 100 is turned, the piston 92 reciprocates. The stub 98 is journalled to the piston 92 by a bearing 108, which may be, for example, a ball bearing or other type of bearing.

The two pistons 92 at opposite ends of the pump 10 are assembled 180° out of phase from each other so that when one of the pistons is at top dead center, the other piston is at bottom dead center. To accomplish this, each piston 92 is provided with two holes 110 and 112. The two holes 110 and 112 are 180° apart from one another about axis 106 and have centers on a line that intersects their centers and intersects the axis 106 of the stub 98. Each eccentric 94 is also provided with a hole 114 that is 180° away from the axis 106 about axis 104, on a line that extends through the axis 106, the axis 104, and the center of the hole 114. All of the longitudinal axes of the holes 110, 112, and 114 are all parallel to the axes 104 and 106. Thus, when the hole 114 is lined up with the hole 110, as shown in FIG. 6, the piston is at its bottom dead center position, and when the hole 114 is lined up with the hole 112, the piston is at its top dead center position.

Figure 10:
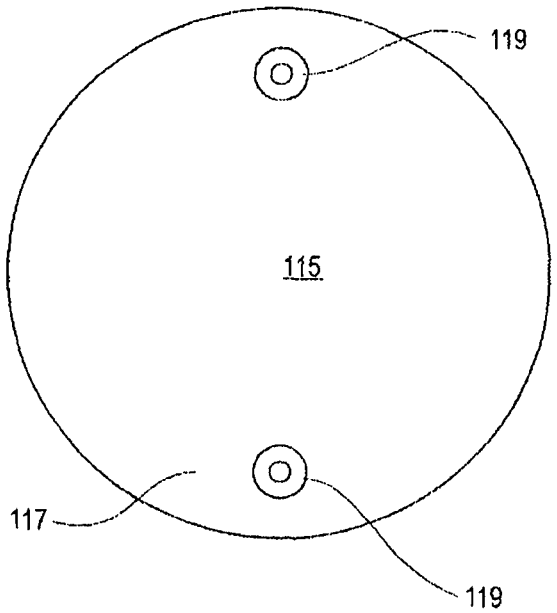
FIG. 10 is a front plan view of a tool for aligning the pistons and the eccentrics when assembling the pistons to the motor shaft.
Figure 11:
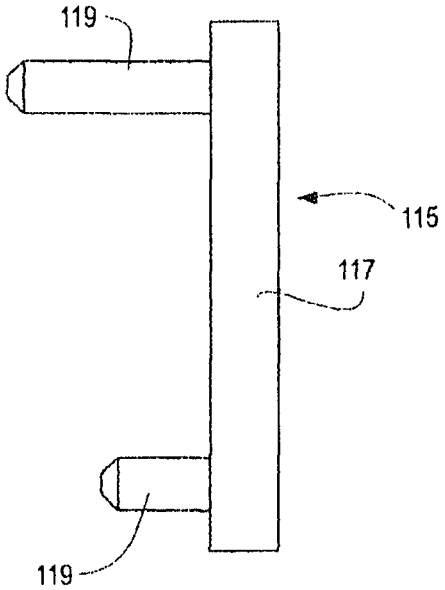
FIG. 11 is a side plan view of the tool of FIG. 10.

A magnetic pin fixture 115 as shown in FIGS. 10 and 11 can be used to align the holes, which is a magnetic disk 117 about the size of the round lower part of the piston 92 that has two pins 119 sticking out of it axially spaced apart to enter the holes 110 and 112, the pins being long enough to also extend through the hole 114. The magnetic disk holds the fixture against the stub 98 or bearing 108 while the set screw is tightened against the shaft 100. At one end, this is done with the piston 92 at the bottom dead center position, and while leaving the fixture in that position, holding the bottom dead center position, the other end of the pump is assembled with the piston 92 at the top dead center position, using a similar fixture 115. When both set screws are tightened, thus fixing the positions of the pistons on the shaft 100, the magnetic fixtures can be removed. Note that the set screws are accessible through the intake holes 42, 44.

A pump 10 like that described above would typically be mounted from the housing some form of mounting bracket, which mounting bracket may include vibration isolators, such as elastomeric components. Tubing would then be run from the inlet and outlet ports to make connections to the pump, and typically the tubing would have excess slack in it so that the vibrations of the pump are not transmitted through the tubing to other parts of the machine.

Figure 12:
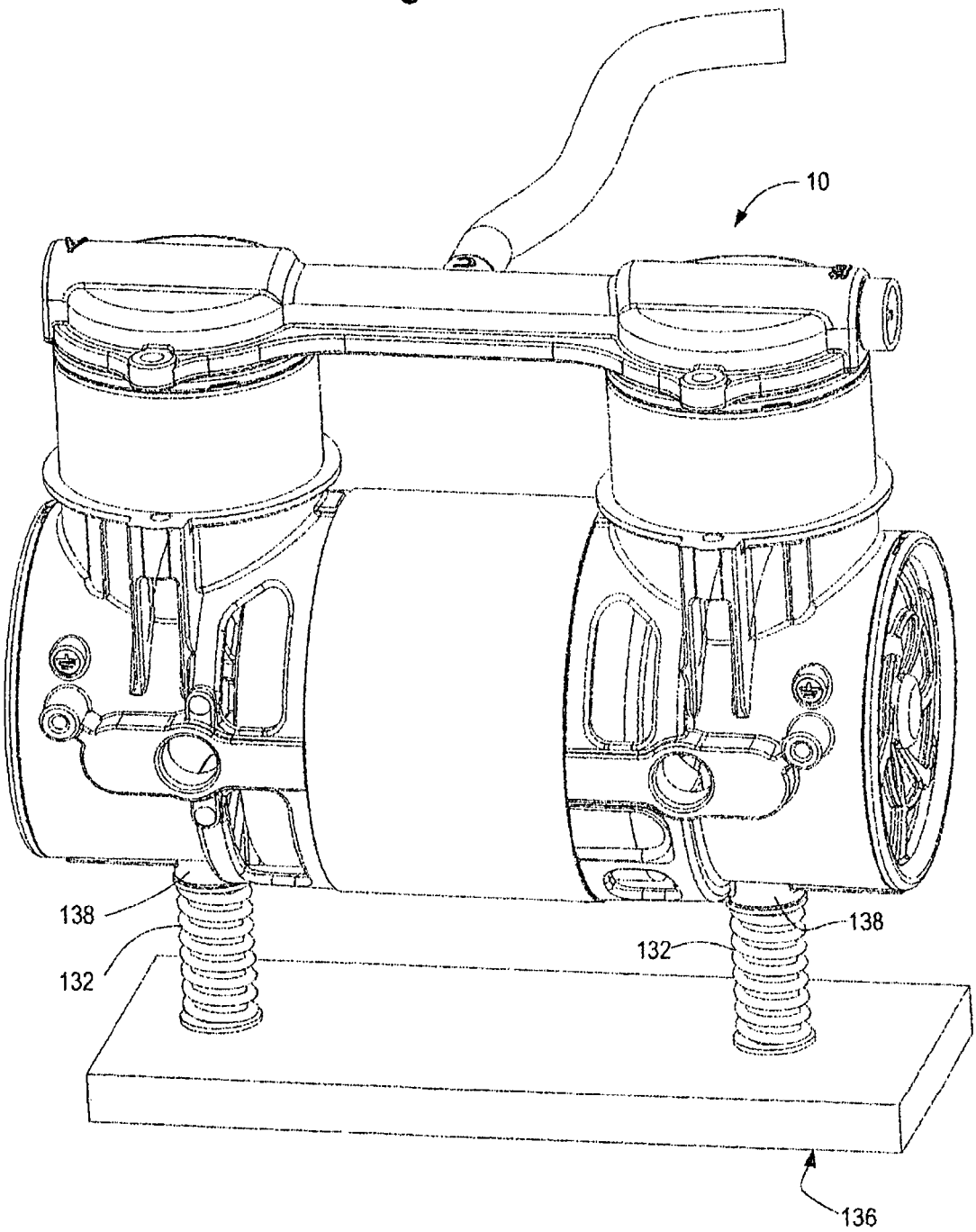
FIG. 12 is a schematic perspective view illustrating a mount of the invention using two mounting points.

FIG. 12 illustrates a mount of the invention in which tubing 132 mounts the pump 10 to a base 136. The tubing 132 is preferably made of an elastomeric material, as soft as possible, but still capable of supporting the pump 10. The tubing 132 also provides the passageway for air to enter inlet ports 138 of the pump, which are screwed into the holes 42, 44 in the bottom of the pump. The base 136 is an intake manifold or other manifold for the pump 10 containing passageways to direct the flow either to the pump 10 if the tubes 132 are connected to intake ports, or to the flow from the pump 10 if the base 136 is connected to the outlet port(s).

Figure 13:
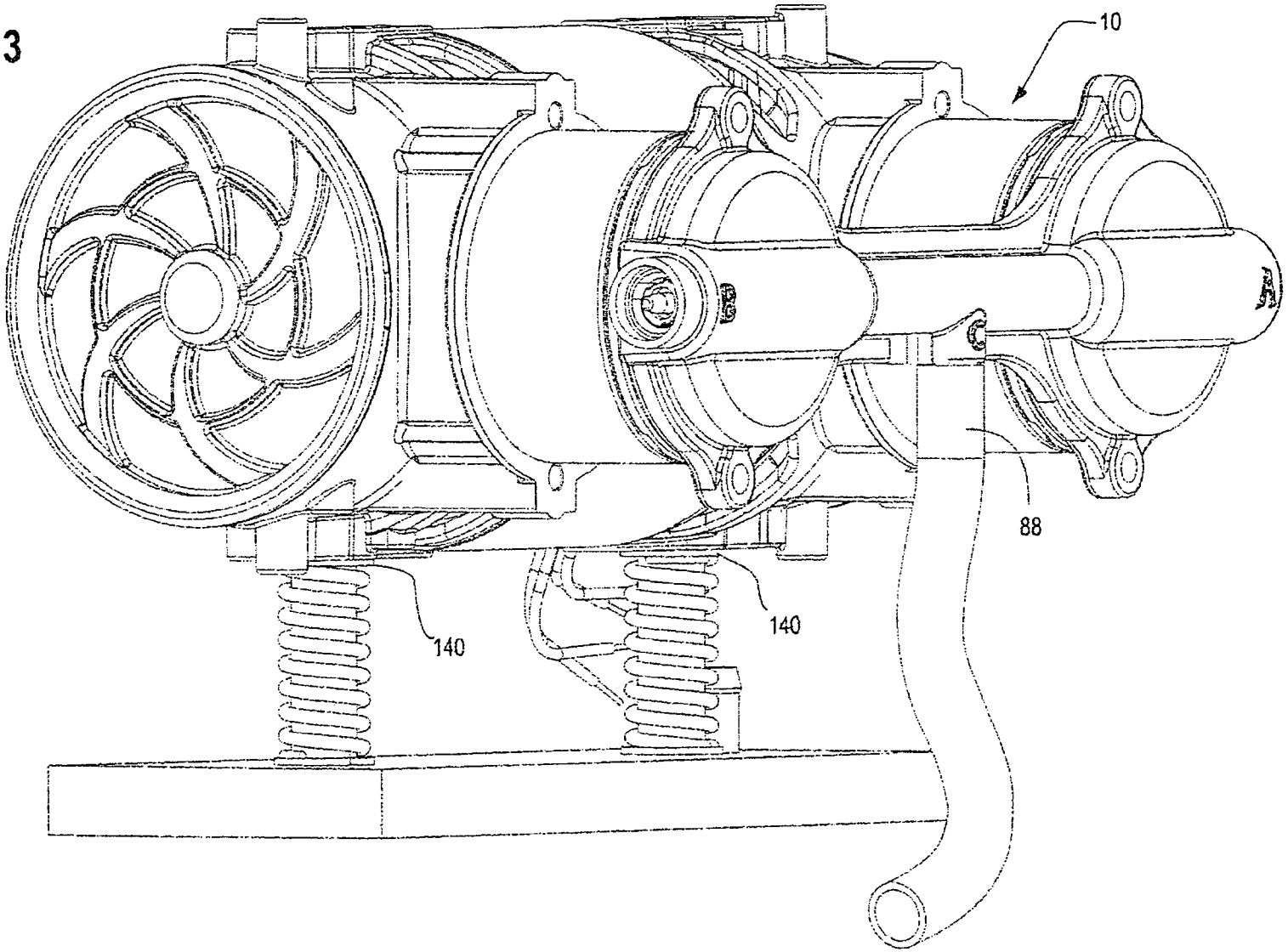
FIG. 13 is a view like FIG. 12 but illustrating an alternative using three mounting points.

FIG. 13 illustrates an alternate embodiment in which the pump 10 is mounted on its side. Intake ports 140 are provided in the side of each of the housings, rather than in the bottom, and tube mounts like the mounts 132 of FIG. 13 are provided for each of the inlet ports 140 and with the outlet port 88 provide a three-point mount for the pump 10. Tube mounts connected to the ports 140 would provide air into the pump 10 and the tube mount from the port 88 would provide a passageway for air from the pump 10. All three ports could be connected to the same base, which could provide a manifold for both the inlet air and the outlet air.

Figure 14:
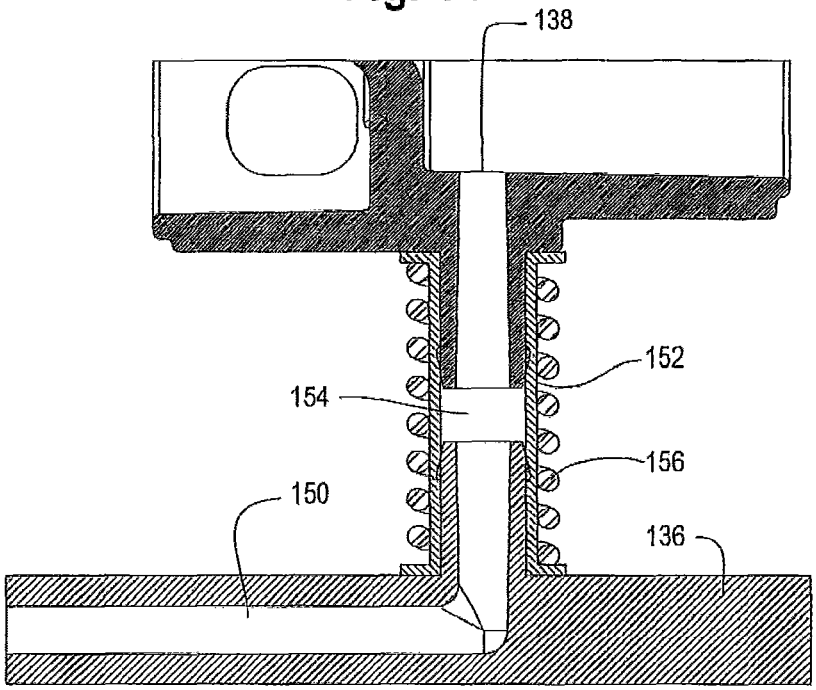
FIG. 14 is a detail view of one of the mounts.

FIG. 14 illustrates a more detailed configuration for a tube mount 152, which may be used in place of mount 132. Port 138 is connected to port 150 of the base 136 by the tube mount 152 that has flanges molded into it at each end. Gussets may also be provided between the central portion of the tube mount and the flanges. A fitting stop 154 may be molded as part of the tube mount or may be provided separately between the ends of the ports 138 and 150 or may be left out if the tube mount is stiff enough to support the pump. A compression spring 156 is between the flanges of the tube mount 152 for additional support for the pump 10. The tube mount 152 is preferably molded of an elastomeric material that is as soft as possible so as to absorb as much vibration as possible at the lowest frequency, and still support or help support the pump 10 while providing flow to or from the pump.

Figure 15:
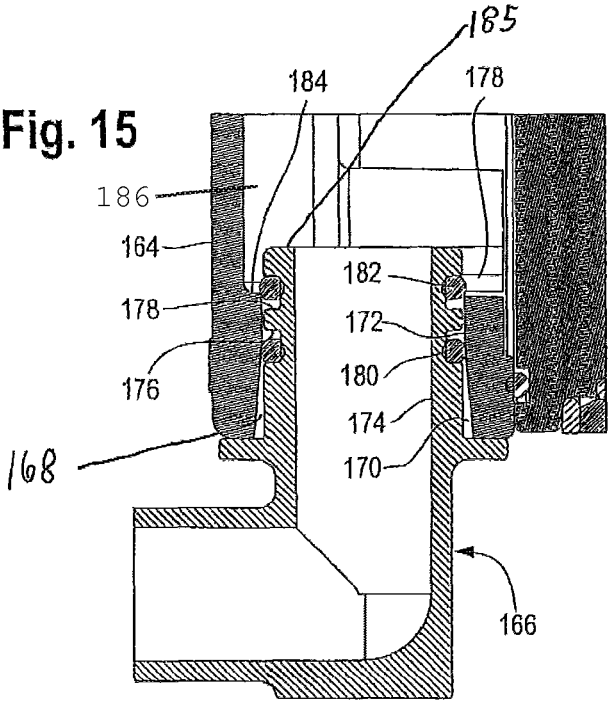
FIG. 15 is a cross sectional view taken from the longitudinal axis of a generally cylindrical push-in port fitting.
Figure 16:
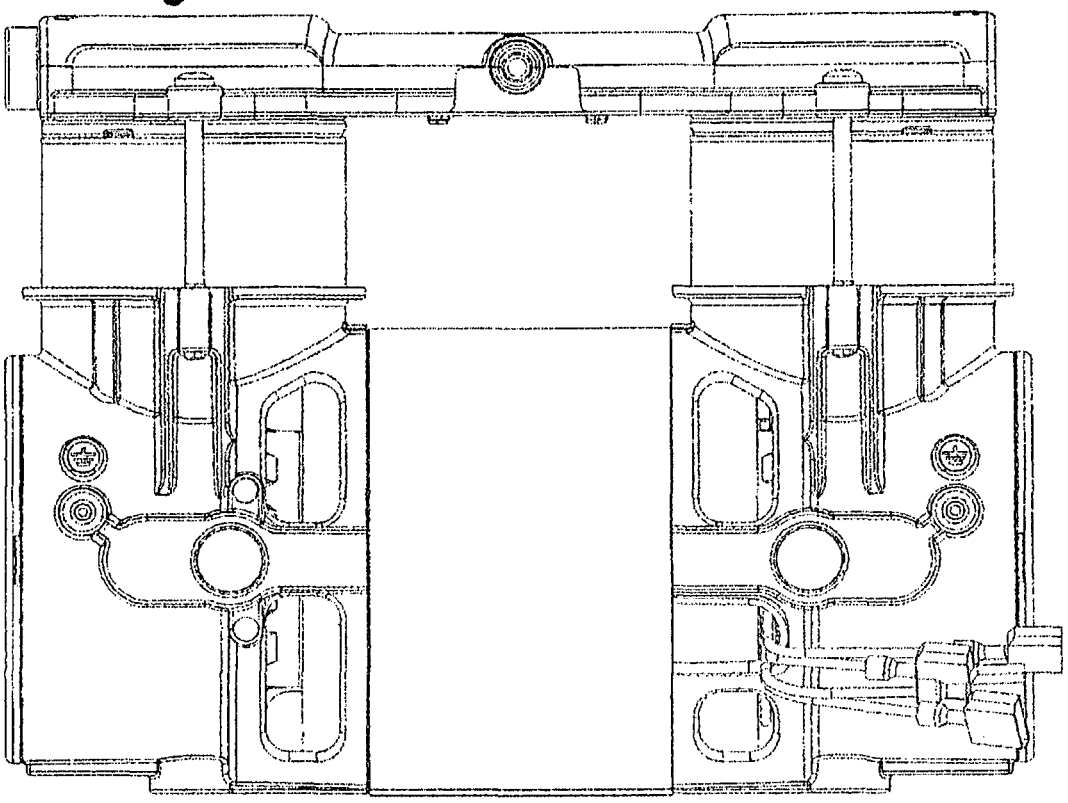
FIGS. 16-21 are front, rear, right end, top, left end and bottom plan views of the pump of FIG. 1.
Figure 17:
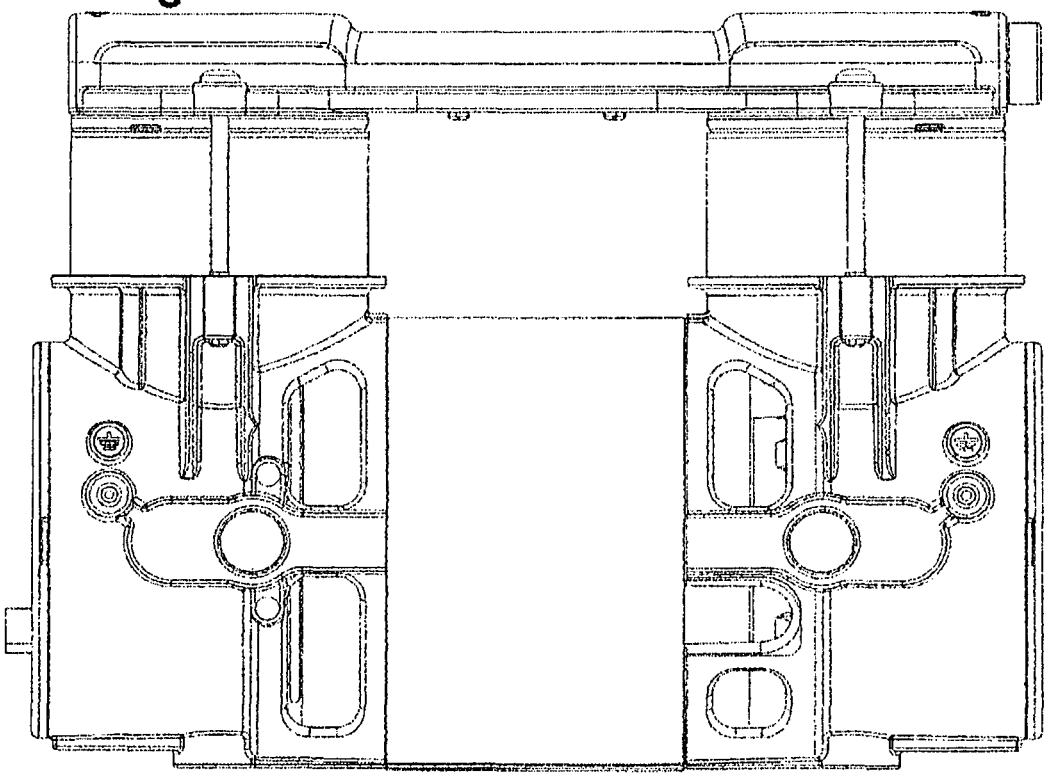
Figure 18:
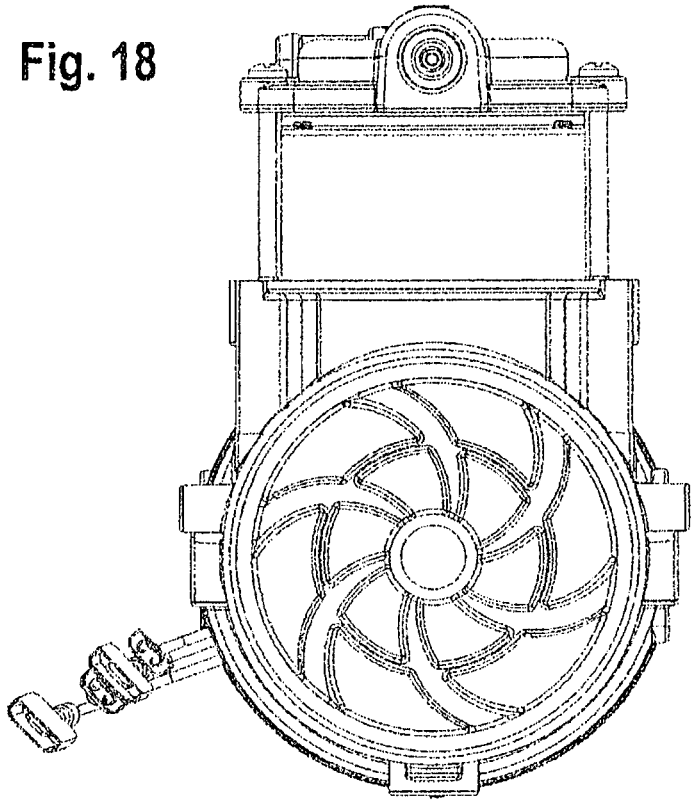
Figure 19:
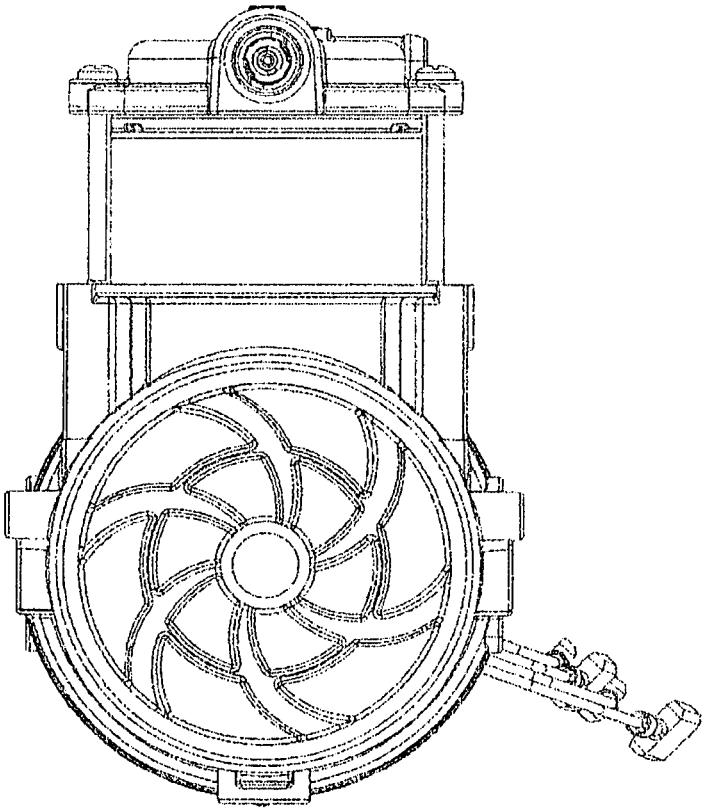
Figure 20:
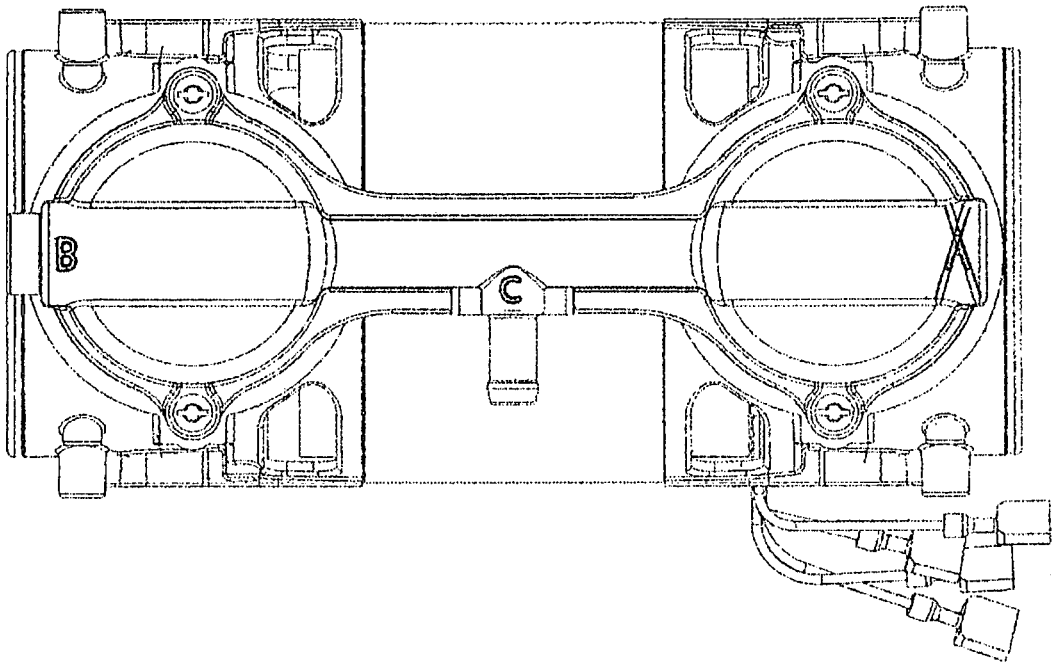
Figure 21:
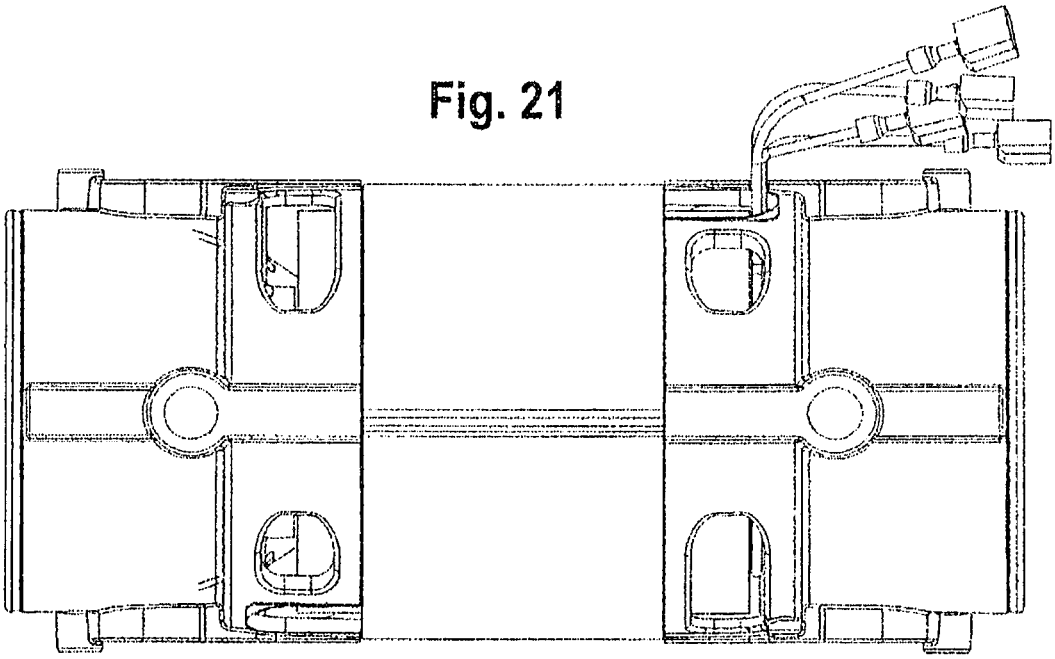

FIG. 15 illustrates how a fitting like the ports 138, 140, 150, or the plug 160 (FIG. 2) may be provided in a body such as the base 136, the housing 12 or 14, or the head 30 to create a connection between the body. In FIG. 15, the body is identified by reference number 164. The fitting 166, as illustrated in FIG. 15, is a port. The body 164 has a circular opening 168 opening into a hollow 186, the opening having a chamfered portion 170 that tapers in the direction toward the interior of the body 164 and a cylindrical portion 172 inward of the chamfer 170. The fitting 166 has a forward portion 174 with an open end 185 that defines on its outer surface a seal groove 176 and a retaining ring groove 178. The forward portion can also be called an insert portion or an insert. A sealing 180, which may be a standard o-ring, a quad ring, a square section o-ring, or any other kind of sealing ring, encircles the forward portion 174 in the seal groove 176. A retaining ring 182 is received in the retaining groove 178 and may be an elastomeric ring that is either a standard o ring, a quad ring, a square section o-ring, or any other kind of compressible and expandable ring, which may be elastomeric, plastic, or metal, and may be either split or not. The seal ring 180 seals against the cylindrical portion 172 in conventional fashion. However, the retaining ring 182, upon insertion of the fitting 166 into the hole 168, is initially compressed by the chamfer 170 and slides through the opening 168 until it clears the inner edge (184) of the opening 168, at which point it expands out to interfere with the inner edge 184 of the opening to retain the fitting 166 in the opening 168. This provides easy push-in assembly of the fitting 166 to the body 164 and a secure connection of the fitting 166 to the body 164. Although a port has been described, the fitting 166 could be a plug, pressure relief valve, a portion of a filter, muffler, attenuator, or gauge, or another device or pump component requiring coupling to an aperture.

A preferred embodiment of the invention has been described in considerable detail. Many modifications and variations to the preferred embodiment described will be apparent to a person of ordinary skill in the art. Therefore, the invention should not be limited to the embodiment described, but should be defined by the claims which follow.

We claim:

1. An assembly of a pump comprising:

a first housing and a second housing, said first housing having a first cylinder, said second housing having a second cylinder; a motor between said first and second housings; first and second piston assemblies coupled to opposite ends of a shaft of said motor, the end of said shaft coupled to said first piston assembly extends into said first housing, the end of said shaft coupled to said second piston assembly extends into said second housing;

each piston assembly including a piston and an eccentric having a counterweight portion and a stub portion, each said stub portion having a first axis; the eccentric having a hole with a second axis parallel to the first axis and spaced from the first axis, a respective end of the opposite ends of the motor shaft is received in each hole, each eccentric is coupled to the motor shaft, and wherein, each stub portion is journalled to a respective one of the pistons of the first and second piston assemblies, and wherein, the piston of the first piston assembly has at least a first alignment opening which opens through a surface of said piston and extends into said piston, said first alignment opening having an axis parallel to the first and second axes, and the eccentric of said first piston assembly has an alignment opening which opens through a surface of said eccentric and extends into said eccentric, and wherein when the eccentric alignment opening is aligned with the first alignment opening, the piston is in one of a top dead center position or a bottom dead center position, and a first straight pin is insertable into said eccentric alignment opening and said first alignment opening so the pin extends into both the eccentric alignment opening and the first alignment opening at the same time, and said pin is parallel to said second axis of said hole of the eccentric of the first piston assembly which receives said motor shaft.

2. An assembly of a pump comprising:

a first housing and a second housing, said first housing having a first cylinder, said second housing having a second cylinder; a motor between said first and second housings; first and second piston assemblies coupled to opposite ends of a shaft of said motor, the end of said shaft coupled to said first piston assembly extends into said first housing, the end of said shaft coupled to said second piston assembly extends into said second housing;

each piston assembly including a piston and an eccentric having a counterweight portion and a stub portion, each said stub portion having a first axis; each eccentric having a hole with a second axis parallel to the first axis and spaced from the first axis, a respective end of the opposite ends of the motor shaft is received in each hole, each eccentric is coupled to the motor shaft, and wherein, each stub portion is journalled to a respective one of the pistons of the first and second piston assemblies, and wherein, the piston of the first piston assembly has at least a first alignment opening which opens through a surface of said piston and extends into said piston, said piston of said first piston assembly has a second alignment opening which opens through a surface of said piston and extends into said piston, said first alignment opening having an axis parallel to the first and second axes, and the eccentric of said first piston assembly has an alignment opening which opens through a surface of said eccentric and extends into said eccentric, and wherein when the eccentric alignment opening is aligned with the first alignment opening, the piston is in a top dead center position and a first straight pin is insertable into said eccentric alignment opening and said first alignment opening so the pin extends into both the eccentric alignment opening and the first alignment opening at the same time; and when said eccentric alignment opening is aligned with said second alignment opening said piston is in a bottom dead center position and said first straight pin is insertable into said eccentric alignment opening and second alignment opening of said first piston assembly so the pin extends into both the eccentric opening and the second alignment opening of the first piston assembly at the same time.

3. The assembly of the pump of claim 1 further comprising a first alignment opening which opens through a surface of the piston of the second piston assembly and extends into the piston of the second piston assembly, and an alignment opening in the eccentric of said second piston assembly, said alignment opening in said eccentric of said second piston assembly opens through a surface of said eccentric and extends into said eccentric, wherein when said first alignment opening in said piston of said second piston assembly is aligned with said eccentric alignment opening of said second piston assembly and wherein when said first alignment opening of said piston of said first piston assembly is aligned with said eccentric alignment opening of said first piston assembly, said pistons are 180° out of phase, and said first straight pin is insertable into said eccentric alignment opening and first alignment opening of said first piston assembly so the pin extends into both the eccentric opening and the first alignment opening of the first piston assembly at the same time and said first straight pin is parallel to said second axis of said hole in said eccentric of said first piston assembly which receives said motor shaft, and a second straight pin is insertable into said eccentric alignment opening and first alignment opening of said second piston assembly so the pin extends into both the eccentric opening and the first alignment opening of the second piston assembly at the same time.

4. The assembly of the pump of claim 2, further comprising a magnetic fixture having two pins, one of which is said first straight pin and the other of which is another pin, said two pins are extendable simultaneously through the first, second and eccentric alignment opening.

5. The assembly of the pump of claim 1, wherein the first and second housing are mounted to a base, where at least one of said housings has a port, said port connected to an elastomer tubular member at a first end of said member, said tubular member defines at least one passage for communication of a gaseous fluid with said port, the elastomer member having a second end being connected to the base.

6. The assembly of the pump of claim 5, wherein the elastomer tubular member is relaxed when the pump is not operating so as to rest a portion of the pump on a mount and when the pump is operating the tubular member is subjected to pressure or vacuum that lifts the portion of the pump off the mount to support the housing having the port with vibration isolation.

7. The assembly of the pump of claim 1, further comprising a pump fluid port insert that has at least a portion which forms an insert, said insert portion inserted into an opening into said first or second housing, the insert having a deformable ring around a groove formed in said insert portion, said insert portion having an open end, when the insert portion is being inserted into the opening, said ring is compressed between the insert portion and a surface forming said opening into said first or second housing, and wherein when inserted the ring clears an end inner edge at an end of said opening with sufficient depth of insertion and the ring is expanded outwardly to inhibit removal of the fluid port insert portion.

8. The assembly of the pump of claim 7, wherein said pump fluid port insert further comprises a second ring axially spaced further away from said open end than the deformable ring, said second ring is a sealing ring between the pump fluid port insert portion and the surface forming said opening into said first or second housing.

9. The pump assembly of claim 8, wherein the deformable ring is an elastomeric ring, a metal split ring, or a plastic split ring.

10. The assembly of the pump of claim 1 further comprising a head member formed from a pair of head members; a tube spans the head members and is formed integral with each head member; a port is integrally formed with and extends from said tube to provide a passageway into the tube; the head members, tube and port are a single piece of continuous material, said tube provides a handle.

11. The assembly of the pump of claim 1 further comprising a cover and a sealing ring, wherein an opening in an end of the first housing has said cover fit therein, said sealing ring resides between the cover and an inner cylindrical surface of the housing to provide the only constant force holding the cover within the housing.

12. A pump fluid port insert with an insertable portion in combination with a first opening which opens into a hollow defined by a pump housing, said insertable portion insertable into said hollow, a pump fluid port and said first opening and said hollow comprising:

a first groove in said insertable portion, said insertable portion having a first end, with the first end being sized to pass over an end inner edge of the first opening, said end inner edge defines an end of said first opening, at said end, said first opening opens into said hollow, said first groove adjacent said first end, the first groove being sized to hold a first resilient deformable element, wherein when the pump fluid port insert has the first deformable element and is inserted in the first opening, the first deformable element clears the end inner edge with sufficient depth that it expands outwardly to interfere with said inner edge, said inner edge forming an end of said first opening through a wall of the housing, the insertable portion has a second groove spaced from the first groove and the second groove being sized to hold a sealing ring said second groove axially spaced from said first groove and not overlapping said hollow.

13. The pump fluid port insert of claim 12, wherein the first deformable element is in the first groove.

14. The pump fluid port insert of claim 13, wherein the second deformable element is in the second groove.

15. Piston assemblies of a pump comprising: first and second piston assemblies coupled to opposite ends of a shaft of a motor, each piston assembly including a piston and an eccentric having a counterweight portion and a stub portion, each said stub portion having a first axis; each eccentric having a hole with a second axis parallel to the first axis and spaced from the first axis, a respective end of the opposite ends of the motor shaft is received in each hole, said eccentric is coupled to the motor shaft, and wherein, each stub portion is journalled to a respective one of the pistons of the first and second piston assemblies, and wherein, the piston of the first piston assembly has at least a first alignment opening which opens through a surface of said piston of said first piston assembly and extends into said piston, said first alignment opening having an axis parallel to the first and second axes, and the eccentric of said first piston assembly has an alignment opening which opens through a surface of said eccentric and extends into said eccentric wherein when the eccentric alignment opening is aligned with the first alignment opening, the piston is in one of a top dead center position or a bottom dead center position, and an axis extends through said alignment opening which opens through said surface of said eccentric, said axis of the eccentric alignment opening extending through said alignment opening is parallel to the motor shaft.

16. An assembly of a pump comprising:

a first housing and a second housing, said first housing having a first cylinder, said second housing having a second cylinder; a motor between said first and second housings; first and second piston assemblies coupled to opposite ends of a shaft of said motor, the end of said shaft coupled to said first piston assembly extends into said first housing, the end of said shaft coupled to said second piston assembly extends into said second housing;

each piston assembly including a piston and an eccentric having a counterweight portion and a stub portion, said stub portion having a first axis; the eccentric having a hole with a second axis parallel to the first axis and spaced from the first axis, a respective end of the opposite ends the end of the motor shaft is received in each hole, each said eccentric is coupled to the motor shaft, and wherein, each said stub portion is journalled to a respective one of the pistons of the first and second piston assembly, and wherein, the piston of the first piston assembly has at least a first alignment opening which opens through a surface of said piston and extends into said piston, said first alignment opening having its axis parallel to the first and second axes, and the eccentric of said first piston assembly has an alignment opening which opens through a surface of said eccentric and extends into said eccentric, and wherein when the eccentric alignment opening is aligned with the first alignment opening, the piston is in one of a top dead center position or a bottom dead center position, and wherein said piston alignment opening has opposite open ends, and wherein, a first straight pin is insertable into said eccentric alignment opening and said first alignment opening so the pin extends into both the eccentric alignment opening and the first alignment opening at the same time and at that time said pin extends through said opposite open ends of said piston alignment opening.

17. A fluid port insert with an insertable portion in combination with a fluid port which opens into a hollow defined by a pump housing, said insertable portion insertable into said fluid port, said fluid port insert and fluid port and said hollow comprising:

said insertable portion having an end, with the end being sized to pass over an end inner edge of the fluid port, said end inner edge defines an end of said fluid port, said end is in said hollow, a first deformable element, sealing ring spaced axially further from said end of said insertable portion than said first deformable element, said first deformable element extending from a portion of said insert in the radial direction and the sealing ring extending from a portion of said insert in the radial direction, the radial direction being relative to the axial direction over which the first deformable elements and the sealing ring are spaced, wherein when the insertable portion is inserted in the fluid port, the first deformable element clears the end inner edge with sufficient depth that it expands outwardly to inhibit removal of the first deformable element over the inner edge, and said sealing ring element is in said fluid port which opens into said hollow, wherein said end inner edge forms an end of said fluid port opening through a wall of the housing.

* * * * *